US006757404B2

(12) United States Patent
Takewa et al.

(10) Patent No.: US 6,757,404 B2
(45) Date of Patent: Jun. 29, 2004

(54) LOUD SPEAKER, DIAPHRAGM AND PROCESS FOR MAKING THE DIAPHRAGM

(75) Inventors: Hiroyuki Takewa, Kaizuka (JP); Mikio Iwasa, Katano (JP); Mitsukazu Kuze, Osaka (JP); Shinya Tabata, Mie Pref. (JP); Shinya Mizone, Tsu (JP); Yoshiyuki Takahashi, Matsuzaka (JP); Satoshi Koura, Mie Pref. (JP); Takashi Suzuki, Mie Pref. (JP); Teruo Doi, Tsu (JP); Kiyoshi Ikeda, Matsuzaka (JP); Hiroko Yamazaki, Matsuzaka (JP)

(73) Assignee: Matsushita Electric industrial Co., Ltd., Kadoma (JP)

( * ) Notice: Subject to any disclaimer, the term of this patent is extended or adjusted under 35 U.S.C. 154(b) by 164 days.

(21) Appl. No.: 09/988,228

(22) Filed: Nov. 19, 2001

(65) Prior Publication Data

US 2002/0061117 A1 May 23, 2002

(30) Foreign Application Priority Data

Nov. 20, 2000 (JP) ..... 2000-352597

(51) Int. Cl.[7] ..... H04R 25/00

(52) U.S. Cl. ..... 381/430; 381/423; 381/424; 181/174

(58) Field of Search ..... 381/396, 398, 381/400, 407, 412, 423, 424, 430; 181/164, 173, 174

(56) References Cited

U.S. PATENT DOCUMENTS 3,046,362 A * 7/1962 White ..... 381/430
4,532,383 A * 7/1985 Willy ..... 381/423
6,570,995 B2 * 5/2003 Ohashi ..... 381/430

FOREIGN PATENT DOCUMENTS

JP 53-29116 A 3/1978
JP 5-88091 U 11/1993

* cited by examiner

*Primary Examiner*—Suhan Ni
(74) *Attorney, Agent, or Firm*—Smith Patent Office

(57) ABSTRACT

A diaphragm is gained by the co-molded of a dome part, a voice coil junction part, a cone part and a peripheral part through the injection mold of thermoplastic resin. The thickness of the central part of the dome is made great so that the resonance amplitude in this part becomes small. In addition, an annular rib is integrally provided to the voice coil junction part so as to increase the junction strength between the diaphragm and the voice coil bobbin. Thus, the electromagnetic driving force of the voice coil can be effectively transmitted to the diaphragm so that a loud speaker with excellent characteristics can be gained.

18 Claims, 29 Drawing Sheets

LOUD SPEAKER, DIAPHRAGM AND PROCESS FOR MAKING THE DIAPHRAGM

BACKGROUND OF THE INVENTION

1. Field of the Invention

The present invention relates to a loud speaker for high frequency sound that reproduces sound signals and to a diaphragm used for such a loud speaker as well as to a process for a diaphragm.

2. Discussion of the Related Art

In recent years, as music sources to be reproduced are digitized, a loud speaker with more excellent characteristics has been in demand by audio related industries as a sound output apparatus. As for the characteristics of a loud speaker, improvements in a conventional loud speaker such as higher output sound level, lower distortion and flatter frequency response are required. In particular, gaining a diaphragm of a loud speaker for reproducing high frequency sound (also referred to as a tweeter) which greatly affects the quality of sound and establishing a making process therefore have grown in importance. In a conventional loud speaker for reproducing high frequency sound, a dome shaped diaphragm utilizing a polymer film or a resin in a sheet form is used. Here, the dome shaped diaphragm is manufactured by heating and molding the polymer film, or the resin in a sheet form, in a metallic mold.

FIG. 1 is a cross section view, showing an example of a structure of a loud speaker using a polymer film according to a prior art, which shows the right half of the loud speaker from the central axis. As shown in this figure, a dome shaped diaphragm 1 is a diaphragm formed by heating and applying pressure to a polymer film or to a resin material in a sheet form, wherein a dome part 2, a dome central part 3, a voice coil junction part 4, surrounds 5*a* and a frame pasting part 5*b* are formed. Here, the surrounds 5*a* and the frame pasting part 5*b* are referred to as a peripheral part 5. The frame pasting part 5*b* is defined as the part which is adhered to the attachment surface of a frame 13. The surrounds 5*a* are defined as the part of the peripheral part 5 which elastically changes through the vibration of the diaphragm 1. Such surrounds are referred to as a plane edge. In addition, the dome central part 3 is defined as the top part of the dome part 2 while the voice coil junction part 4 is defined as the lower part of the dome part 2.

A voice coil bobbin 6 is a cylindrical member formed of an aluminum foil, of a thin high polymer foil, of a sheet of paper, or the like. The top edge thereof is bonded to the voice coil junction part 4 by means of adhesive 7. A voice coil 7, which generates an electromagnetic driving force, is wound around the lower part of the voice coil bobbin 6. A top plate 8 in a circular form is arranged inside of the voice coil bobbin 6 while a yoke 9 in a cup form is arranged outside of the voice coil bobbin 6. In addition, a magnet 10 is arranged between the bottom surface of the top plate 8 and the flat plane surface of the yoke 9. The top plate 8, the magnet 10 and the yoke 9 form a magnetic circuit 11. Then the gap between the external periphery side of the top plate 8 and the internal periphery side of the yoke 9 becomes an annular magnetic gap 12.

The peripheral part 5 is formed in an annular plate and is attached to the frame 13 with the frame pasting part 5*b* intervened. The voice coil 7 is arranged in the annular magnetic gap 12 and allows the voice coil bobbin 6 to vibrate in a pistonic motion when a driving current corresponding to the audio signal is supplied so as to cause an electromagnetic driving force in the direction parallel to the central axis of the voice coil bobbin 6. This pistonic motion is conveyed to the voice coil junction part 4 so as to allow the diaphragm 1 to vibrate in the direction of the central axis. In the case that the rigidity of the diaphragm 1 is large and the equivalent mass thereof is small, the dome part 2 vibrates integrally when the dome central part 3 is included. At this time, the surrounds 5*a* are elastically transformed. In this manner, the phase of the sound radiated from the diaphragm 1 becomes uniform so that the volume velocity becomes equal to the audio signal.

A conventional making process for such a dome shaped diaphragm is concretely described in the following. FIG. 2 is a cross section view showing the structure of the main components of the metallic mold used for the production of the dome shaped diaphragm. This type of dome shaped diaphragm is conventionally used as a diaphragm of a tweeter for reproducing a high frequency range of sound. Then, as for the material thereof, in general, a resin material 20 in a sheet form is used. The thickness of the sheet is, for example, 50 $\mu$m. FIG. 3 is a cross section view showing the structure of a dome shaped diaphragm 22 in the case that it is manufactured by using a metallic mold 21 of FIG. 2. This diaphragm 22 is partially different from the one shown in FIG. 1 and has a dome part 23, dome central part 24, voice coil junction part 25, cone part 26, roll-surrounds 27 and frame pasting part 28. However, the making process for dome shaped diaphragm 1 of FIG. 1 and the making process for dome shaped diaphragm 22 of FIG. 3 are essentially the same.

The metallic mold 21 shown in FIG. 2 is formed of heat pressure metallic mold 29, which is a male metallic mold, and a heat pressure metallic mold 30, which is a female metallic mold. The molding sides of the heat mold assembly 29 and the heat mold assembly 30 have approximately the same form and heaters for heating, 29*a* and 30*a*, are built in to the respective metallic molds. Each metallic mold has a molding side for the dome part, a molding side for the voice coil junction part, a molding side for the cone part, a molding side for the roll-surrounds and a molding side for the frame pasting part. The heat mold assembly 29 is attached to a shank 29*b* so as to be able to shift between the pressure position and the release position relative to the heat mold assembly 30, which is stationary.

In order to manufacturer a diaphragm 22, a resin material 20 in a sheet form is positioned on the pressure surface of the heat mold assembly 30 and electricity is turned on to the heaters for heating 29*a*, 30*a* of the respective metallic molds so as to heat the respective metallic molds to a predetermined temperature. Then, by pressuring the heat mold assembly 29, which is a male mold, via the shank 29*b*, the pressure between the two metallic molds is maintained at a predetermined value. Thereby, the resin material 20 is softened and melted so as to be plastically transformed into the shape of the molding size of the metallic mold 21.

The diaphragm 22 gained in such a manner has a dome form as shown in FIG. 3 and the thickness thereof varies depending on location. The frame pasting part 28 and the middle part of the dome part 23 become 50 $\mu$m, which is the thickness of the material before molding, while there is a tendency of thinning such that the dome central part 24 becomes 20 $\mu$m, the voice coil junction part 25 becomes 35 $\mu$m and the roll-surrounds 27 become 40 $\mu$m.

In this type of dome shaped diaphragm, though it is ideally desirable to secure the same thickness throughout the entirety, in many cases the pressure between the heat mold assemblies 29, 30 does not spread uniformly throughout the entirety of the diaphragm. Therefore, the thickness varies depending on respective locations within diaphragm 22. In particular, the thickness of the middle part of the dome part 23 differs greatly from the thickness of the dome central part 24 and the voice coil junction part 25. This is because the resin material 20 receives pressure which varies locally in strength when it contacts convex surface parts of the heat mold assemblies 29, 30 at the time of press molding so that the stretched portion expands its area and the thickness of each location varies so as to have uneven values. In particular, the parts essentially require rigidity for high frequency sound reproduction or for distortion reduction, such as the dome central part 24 and the cone part 26, become thin while other parts are formed to be thick. Therefore, distortion increases due to partial resonance and the amplitude of the thin parts become greater than is necessary at the time of resonance. Therefore, there is a problem wherein the peak of the sound level characteristics or the distortion increase. In addition, since the lower part of the dome part 23 becomes thinner, the transmission of the force from the voice coil 7 becomes insufficient and, therefore, there are problems wherein the high frequency range reproduction characteristics are lowered and the input-output characteristic deteriorates.

The diaphragm for a tweeter is required to have a flat frequency characteristic in a range of comparatively high frequency to be reproduced, to be high in sound conversion efficiency, to have broad directional characteristics, and the like. Therefore, most diaphragms have small dimensions, are conventionally formed in a dome form, as shown in FIG. 1, by heating and applying pressure to the resin material 20 in a sheet form or are integrally formed with the cone part 26 in a short cone form around the dome part 23, as shown in FIG. 3. Then, the frame pasting part 28, which has a flat annular surface so as to be fixed to the peripheral part of the frame 13 of FIG. 1, is formed around the outer periphery of the cone part 26.

In particular, the part which becomes the voice coil junction part 25 is pressed to the convex surfaces of the heat mold assemblies 29, 30 so that this junction location becomes thinner and more fragile than the other parts. In such a case, the vibration transmitted from the voice coil 7 to the voice coil bobbin 6 becomes attenuated at the voice coil junction part 25 due to the compliance so as to cause a transmission loss. Therefore, the vibration of a desired mode cannot be sufficiently transmitted. Thus, a sound reproduction faithful to an inputted audio signal cannot be expected and, in addition, the voice coil junction part 25 becomes weakened so that this part is transformed in response to a small input. Furthermore, there is also a problem that a deformation occurs at the adhesion step of the voice coil junction part 25.

In this manner, according to a conventional press molding, the resin material 20 is partially stretched by receiving strong or weak pressure at the time of the molding of the resin material 20 in a sheet form so that the uniformity of thickness of the dome shaped diaphragm 1 or 22 cannot be maintained throughout the respective parts. Variation in thickness at the same part becomes greater for individual diaphragms. Hence, variation occurs in frequency characteristics. In addition, a sufficient thickness cannot be secured in part where rigidity is required. It is practically impossible to gain control so as to achieve a desired rigidity by controlling the thickness of the diaphragm.

In addition, when a thin resin material 20 is utilized in the case of a sheet molding, curvature or other transformations easily occur in the frame pasting parts 5*b* or 28, which presses and fixes the frame 13 and there is the defect that strong attachment to the frame 13 throughout the entire circumference cannot be realized. Accordingly, in the case that large scale production and high quality of the diaphragm are secured, it is difficult to reduce the thickness of the resin material 20 to a certain level, or below so that the thickness is practically limited. In addition, since the resin material 20 is conventionally produced in equipment for mass production, problems arise such that material costs become high and the diaphragm cannot be manufactured at low cost in the case that the thickness does not meet the industrial standards or wherein the resin material is changed. Furthermore, the parts that become the frame pasting parts, 5*b* or 28, are processed so as to be punched out with the required outer diameter, using a press, and, therefore, there is the defect that the remaining part that is not punched out becomes waste so that material loss is increased.

SUMMARY OF THE INVENTION

A loud speaker of the present invention is provided with a diaphragm which has, at least, a dome part and a peripheral part wherein the thicknesses are set at design values in respective locations and which causes an air vibration, a voice coil bobbin in a cylindrical form which is connected to the diaphragm, a voice coil wound around the outer peripheral part of the voice coil bobbin and a magnetic circuit for providing an electromagnetic driving force to the voice coil. In such a structure, the amplitude of the diaphragm at the time of resonance in the high frequency region is controlled, the peak and dip of the high frequency region reproduction frequency is made to be minimal and the characteristic of low distortion in a broad frequency range is implemented.

In addition, a diaphragm of the present invention is characterized in that, by injecting material for molding from a gate by using a male mold assembly and a female mold assembly, a dome part in a substantially hemispherical form, a cone part that is positioned in an outer peripheral part of the dome part and that has a cone surface, surrounds or roll-surrounds that are positioned in an outer peripheral part of the cone part and that elastically support the cone part and a frame pasting part for being fixed to a loud speaker frame that is positioned in an outer peripheral part in the surrounds or in the roll-surrounds are co-molded so as to, respectively, have desired thicknesses. By co-molding the material using such an injection mold method, the thicknesses of the dome part, the cone part, the surrounds and the frame pasting part of the diaphragm are controlled to predetermined values and, thereby, desired frequency characteristics can be gained.

In addition, a first making process for a diaphragm of the present invention uses a male mold assembly and a female mold assembly and injects a material for molding from a gate and, thereby, a dome part in a substantially hemispherical form, a cone part that is positioned in an outer peripheral part of the dome part and that has a cone surface, surrounds or roll-surrounds that are positioned in an outer peripheral part of the cone part and that elastically support the cone part and a frame pasting part for being fixed to a loud speaker frame that is positioned in an outer peripheral part in the surrounds or in the roll-surrounds are co-molded so as to, respectively, have desired thicknesses.

In addition, a second making process for a diaphragm of the present invention carries out a cutting operation on a block of a metal-based material and, thereby, a dome part in a substantially hemispherical form, a cone part that is positioned in an outer peripheral part of the dome part and that has a cone surface, surrounds or roll-surrounds that are positioned in an outer peripheral part of the cone part and that elastically support the cone part and a frame pasting part for being fixed to a loud speaker frame that is positioned in an outer peripheral part in the surrounds or in the roll-surrounds are integrally processed so as to, respectively, have desired thicknesses.

DETAILED DESCRIPTION OF THE PREFERRED EMBODIMENTS

Embodiment 1

Figure 1:
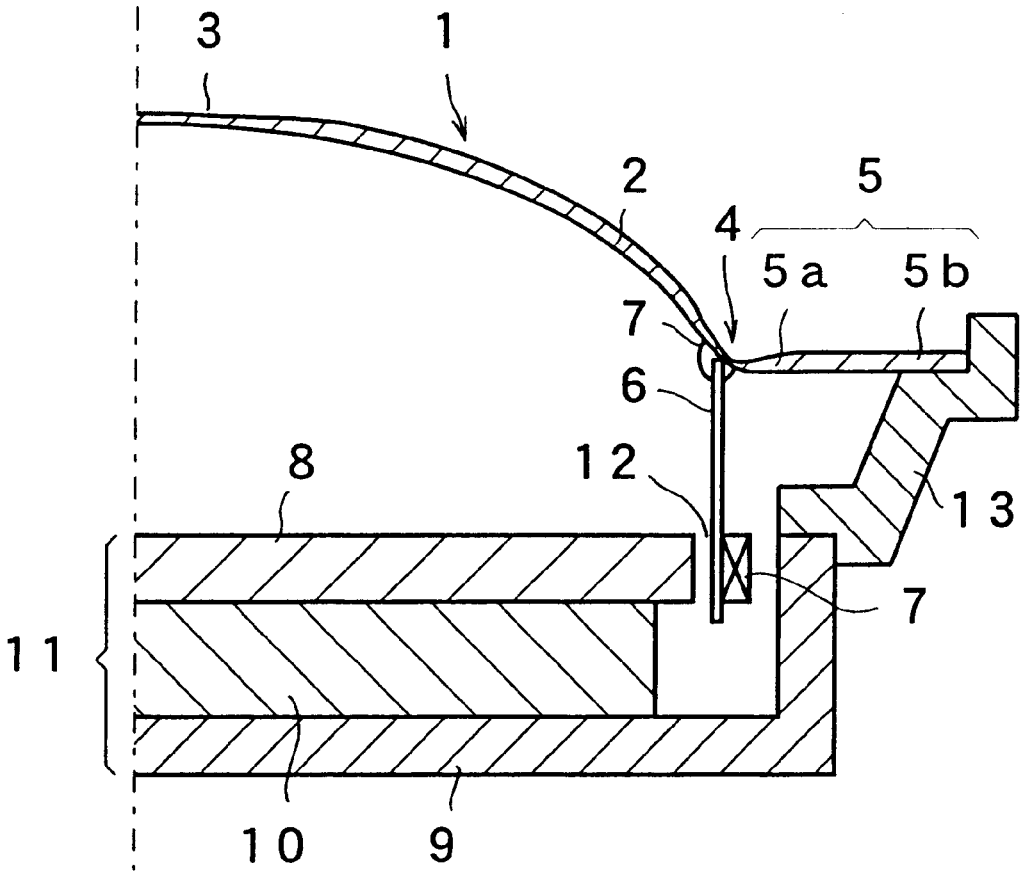
FIG. 1 (PRIOR ART)
FIG. 1 is a cross section view showing half of the structure of a loud speaker according to a prior art.
Figure 2:
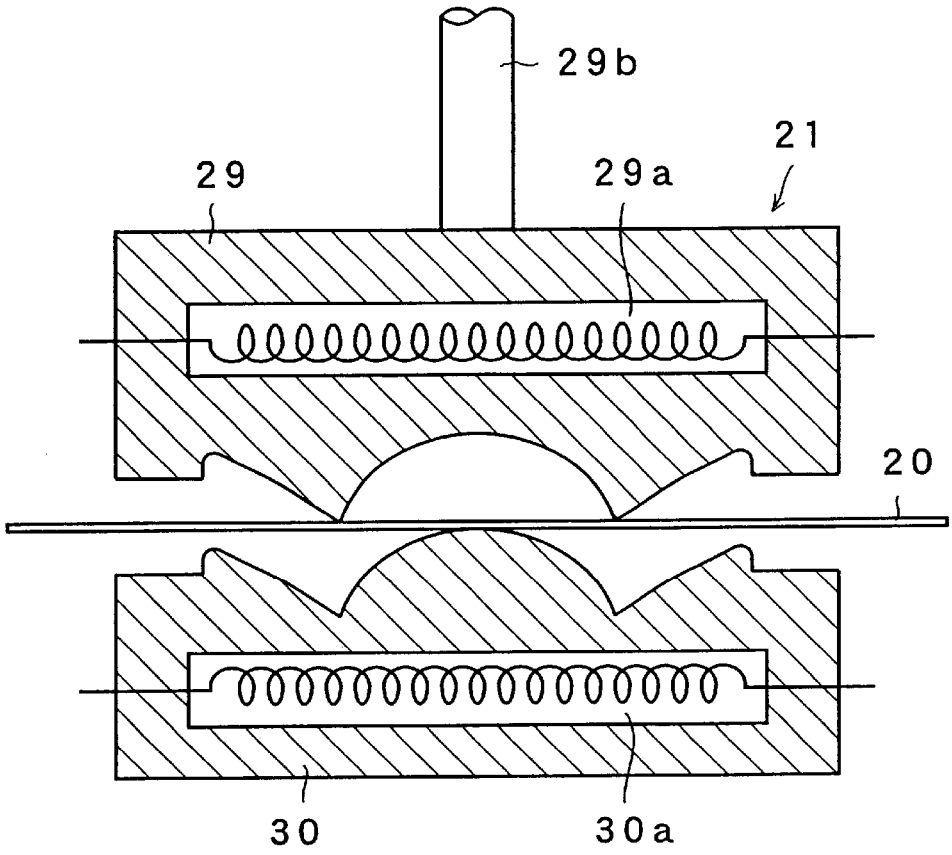
FIG. 2 (PRIOR ART)
FIG. 2 is a schematic cross section view of a metallic mold used for mold of a diaphragm of the loud speaker according to the prior art.
Figure 3:
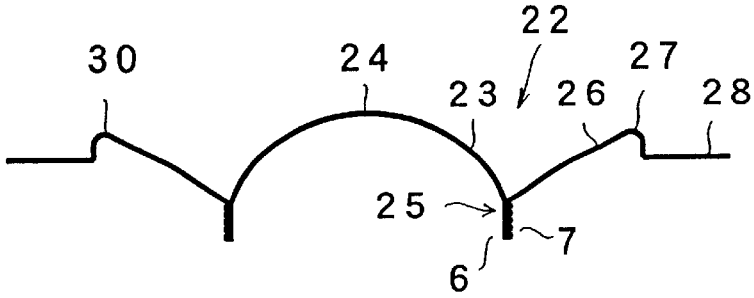
FIG. 3 (PRIOR ART)
FIG. 3 is a cross section view showing the structure of the diaphragm of the loud speaker gained by a process according to the prior art.
Figure 4:
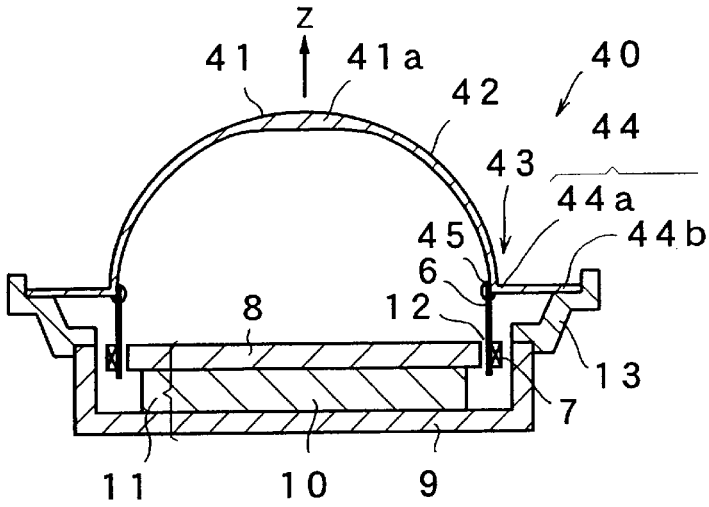
FIG. 4 is a cross section view of the structure of a loud speaker according to Embodiment 1 of the present invention.
Figure 5:
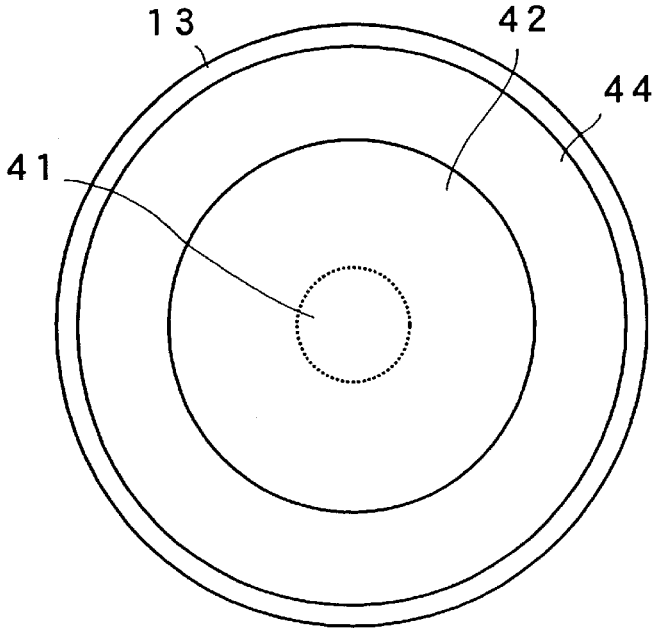
FIG. 5 is a frontal view showing the structure of a diaphragm of the loud speaker according to Embodiment 1 of the present invention.
Figure 6:
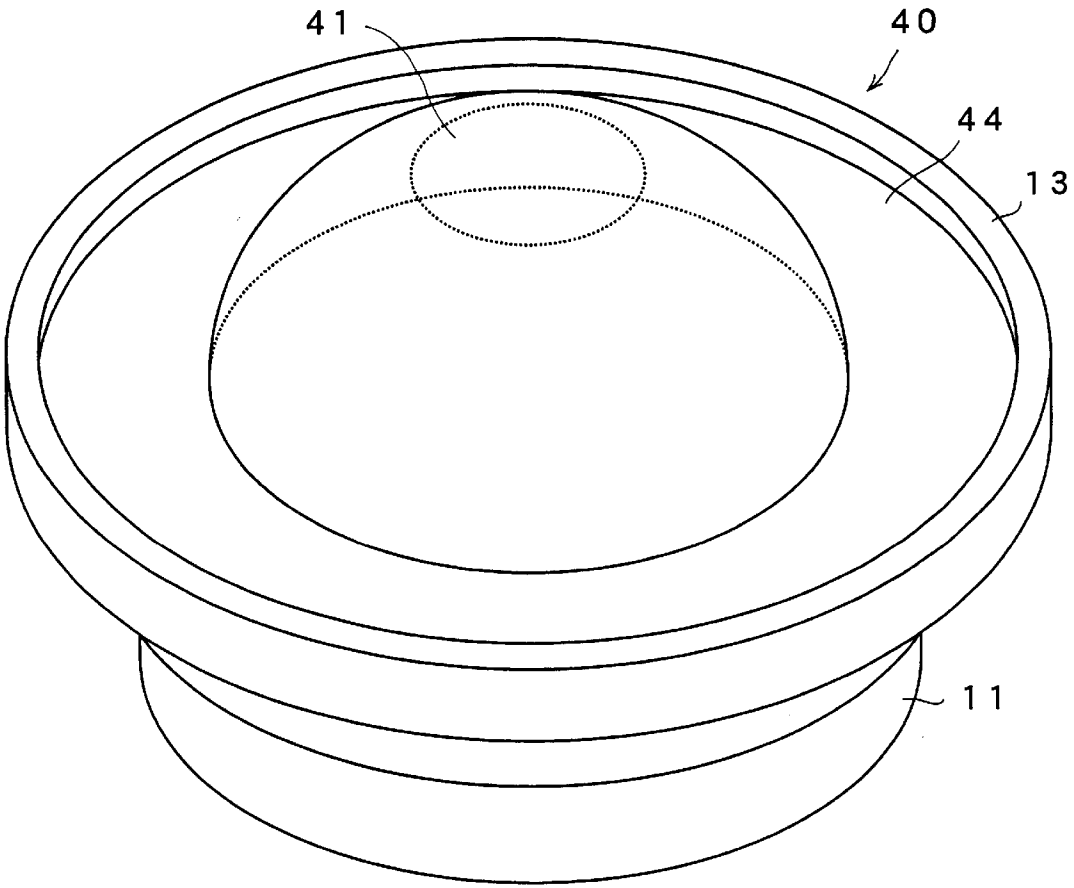
FIG. 6 is a perspective view showing the appearance of the loud speaker according to Embodiment 1 of the present invention.

The structure of the diaphragm of a loud speaker according to Embodiment 1 of the present invention is primarily described in reference to the drawings. Here, in each of the drawings of the embodiment, the same symbols are attached to the same parts (in particular, the magnetic circuit) as in the prior art, of which the detailed descriptions are omitted. FIG. 4 is a cross section view showing the structure of a loud speaker according to the present embodiment. FIG. 5 is a plan view showing the structure of a diaphragm of the present embodiment. FIG. 6 is a perspective view showing the appearance of the loud speaker of the present embodiment. As shown in these figures, this loud speaker is formed to include a dome shaped diaphragm 40 that has a new cross sectional form in addition to a voice coil bobbin 6, a voice coil 7, a plate 8, a yoke 9, a magnet 10 and a frame 13.

This diaphragm 40 is gained through the melting of a readily available resin material including thermoplastic resins, such as polypropylene, polyethylene, polystyrene or ABS, so as to be injected into a metallic mold for injection mold and to be formed into a dome, of which the cross section view shows an arc form of a circle or an approximately hemispherical form. A making process for the diaphragm 40 is described below. As shown in FIG. 4, the diaphragm 40 is integrally formed of a dome part 42, which includes the dome central part 41, a voice coil junction part 43 and of peripheral part 44. The dome central part 41 is a top part of the dome part 42 while the voice coil junction part 43 is the lower part of the dome part 42.

A lump 41*a*, within concentric circles of predetermined diameters, is formed in the dome central part 41 of the diaphragm 40. In the diaphragm 40, the lump 41*a* part is thick while the remaining part is thinner than the lump 41*a* part and has an approximately uniform thickness. When the average thickness of the dome part 42 is, for example, 50 μm, the thickness of the lump 41*a* is 200 μm. In general, it is preferable for the thickness of the dome central part 41 to be two times, or more, greater than the average thickness of the dome part 42. The peripheral part 44 is formed of surrounds 44*a* and a frame pasting part 44*b*. The surrounds 44*a* indicates the part of the peripheral part 44 which is elastically transformed through the vibration of the dome part 42 while the frame pasting part 44*b* indicates the part which is attached to the frame 13. The surrounds 44*a* in a plane form is not intentionally designed so as to be distinguished from the frame pasting part 44*b* but, rather, is functionally distinguished when the peripheral part 44 is in an annular flat plate form. Such a peripheral part 44 is integrally formed with the voice coil junction part 43 and is attached to the frame 13.

The voice coil bobbin 6 is attached to the voice coil junction part 42 by using adhesive 45. The voice coil bobbin 6 is formed in a cylindrical form using aluminum foil, a thin high polymer foil, a sheet of paper, or the like. The voice coil 7 is wound around the lower end of the voice coil bobbin 6 so that the magnetic circuit 11 generates an electromagnetic driving force. The top plate 8 in a disk form and the magnet 10 in a columnar form are arranged inside of the voice coil bobbin 6. The magnet 10 is attached to the flat plate part of the yoke 9 via the lower end of the magnet. The gap between the inner periphery side of the yoke 9 and the outer periphery side of the top plate 8 form an annular magnetic gap 12. The voice coil 7 is positioned in the annular magnetic gap 12. The magnetic circuit 11 is a magnetic path formed of the top plate 8, the magnet 10, the yoke 9 and the annular magnetic gap 12.

The frame 13 is attached to the outer side of the magnetic circuit 11, that is to say, to the cylindrical part of the yoke 9. Then, the diaphragm 40 is held by the frame 13 via the surrounds 44*a* so as to vibrate freely.

When a driving current of an audio signal is inputted to the voice coil 7, an electromagnetic force due to a magnetic flux within the annular magnetic gap 12 generates the driving force in the direction of the z axis, which is the central axis of the loud speaker. Hence, the voice coil bobbin 6 performs a pistonic motion. The vibration thereof is transmitted to the diaphragm 40 via the voice coil junction part 43. When the driving frequency becomes high, the dome central part 41 resonates so that, in general, this part vibrates with an amplitude greater than that of the other parts of the dome part 42. In the present embodiment, however, the lump 41*a*, of which the thickness is great, is formed in the dome central part 41 where the maximum amplitude of the resonance occurs and, therefore, a damping effect of the resonance takes place due to the mass effect of this part. Accordingly, an effect is gained such that the peak of the sound level generated at the time of resonance is made to be low.

Embodiment 2

Next, the structure of the diaphragm of a loud speaker according to Embodiment 2 of the present invention is primarily described in reference to the figures. Here, in the drawings of the present embodiment, the same symbols are attached to the same parts as in Embodiment 1 and as in the prior art, of which the detailed descriptions are omitted.

Figure 7:
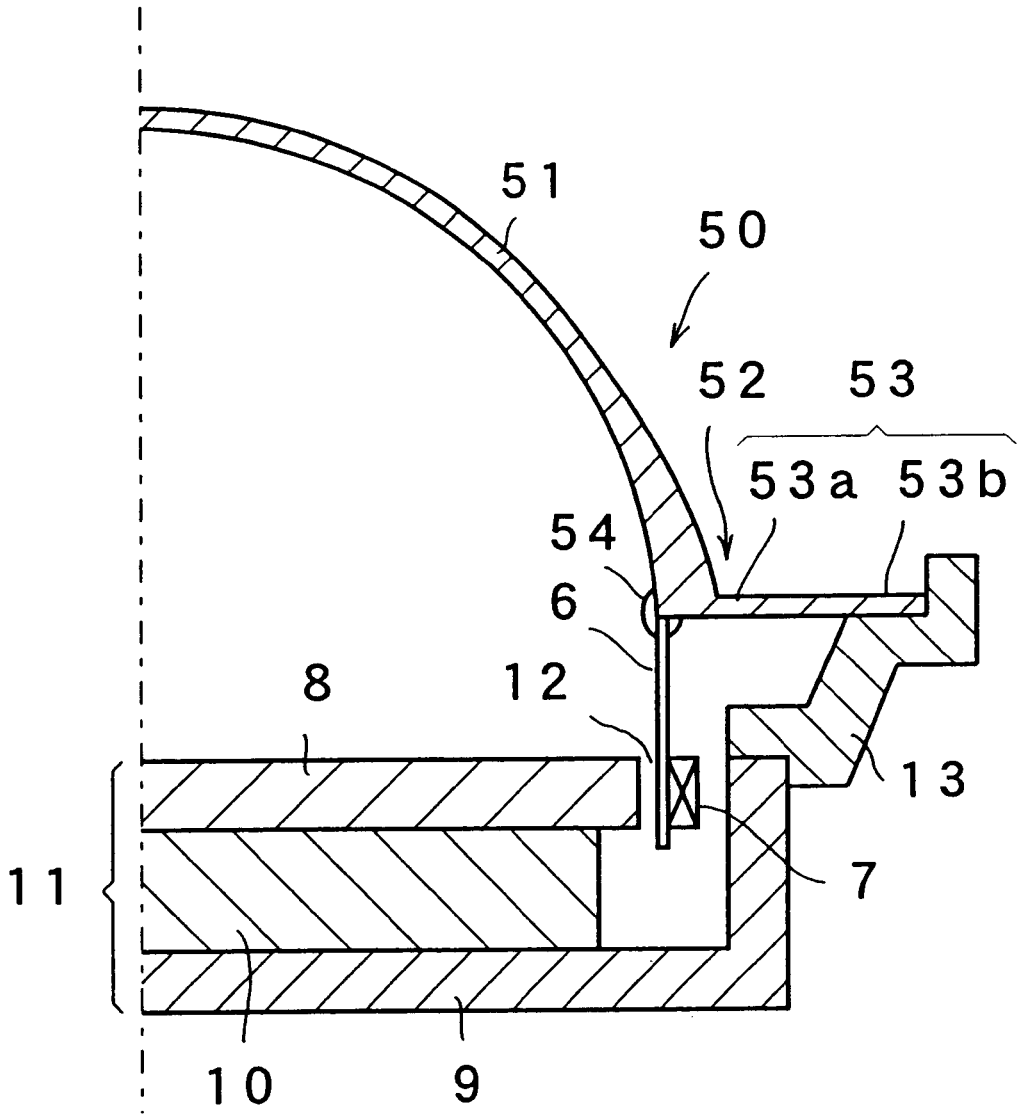
FIG. 7 is a cross section view showing half of the structure of a loud speaker according to Embodiment 2 (part 1) of the present invention.

FIG. 7 is a cross section view showing half of the structure of the loud speaker of the present embodiment. In the description of the present embodiment, and in the following, cross sectional views show half of the main structure of the loud speaker because the structure is symmetrical vis-à-vis the axis. As shown in FIG. 7, this loud speaker is formed to include a voice coil bobbin 6, a voice coil 7, a plate 8, a yoke 9, a magnet 10, a frame 13 and a diaphragm 50, which has a new cross sectional structure.

The diaphragm 50 is a dome shaped diaphragm of which the cross section is of an arc form and is integrally formed of a dome part 51, a voice coil junction part 52 and a peripheral part 53. The voice coil junction part 52 is the lower end part of the dome part 51 and is formed to be thicker than the dome part 51 as shown in FIG. 7. This is in order to convey the driving force of the voice coil 7 to the diaphragm 50 without fail. The parts other than the voice coil junction part 52 have an approximately uniform thickness. The peripheral part 53 is formed of surrounds 53*a* and of a frame pasting part 53*b*. The voice coil bobbin 6 is attached to the voice coil junction part 52 by using adhesive 54. Then, the frame 13, via the peripheral part 53, holds the diaphragm 50.

When a driving current of an audio signal is inputted to the voice coil 7, an electromagnetic force due to a magnetic flux within the annular magnetic gap 12 generates a driving force in the direction of the z axis. Hence, the voice coil bobbin 6 performs a pistonic motion. The vibration thereof is transmitted to the diaphragm 50 via the voice coil junction part 52. Since the voice coil junction part 52 is thicker than the dome part 51, the diaphragm 51 does not become locally transformed due to the increase of rigidity, even in the case that the driving force of the voice coil bobbin 6 increases or in the case that the frequency becomes higher. Therefore, the voice coil bobbin 6 can transmit a driving force to the diaphragm 50 without fail.

Figure 8:
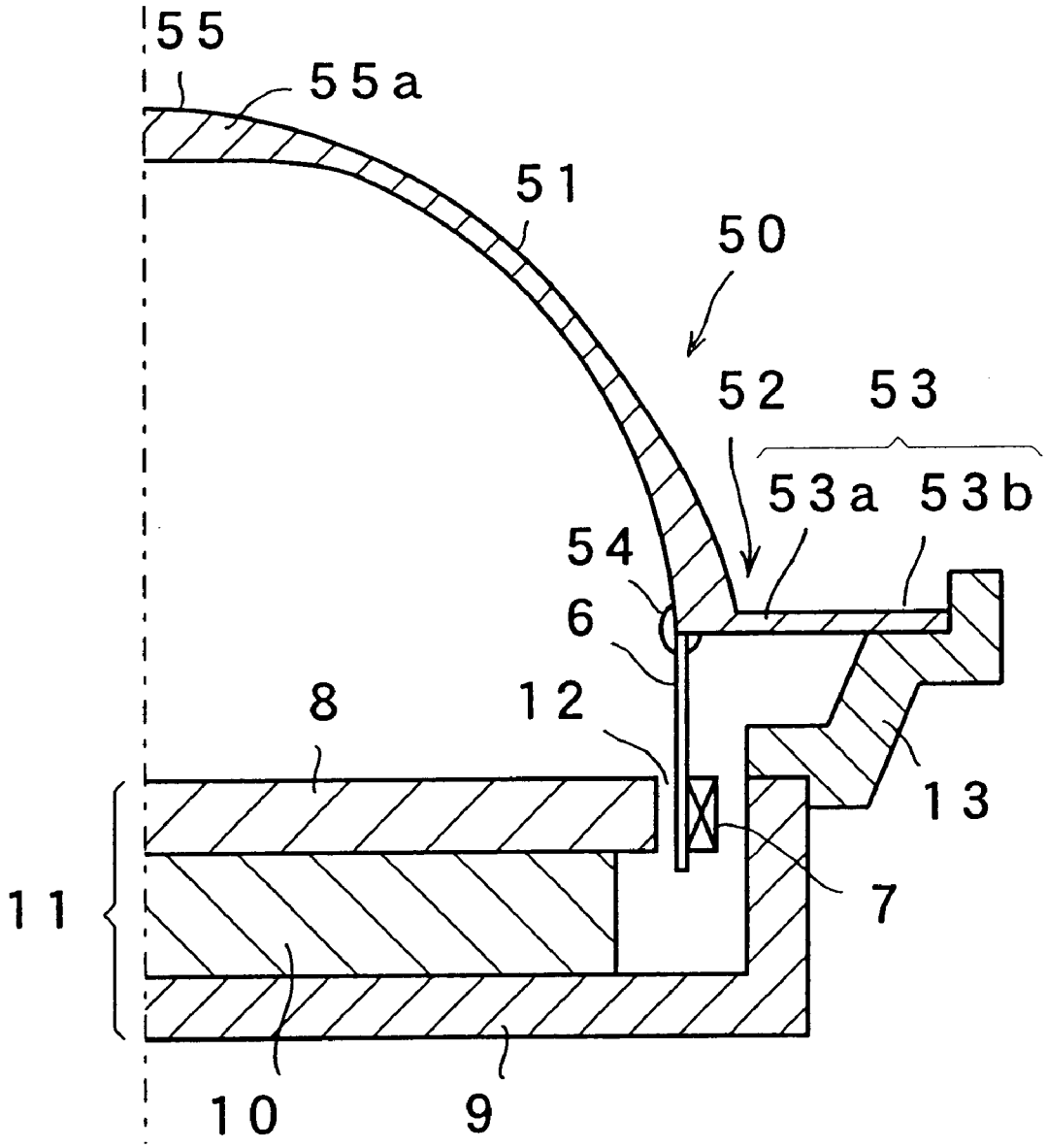
FIG. 8 is a cross section view showing half of the structure of a loud speaker according to Embodiment 2 (part 2) of the present invention.

FIG. 8 is a plan view showing an example wherein the dome central part of the diaphragm 50 is made to be thick, in addition to the above thickening of the voice coil junction part. Here, a lump 55*a*, is thick, is provided within concentric circles in order to give a great thickness to the dome central part 55 of the diaphragm 50. When the driving frequency becomes higher, the dome central part 55 of the diaphragm 50 resonates more easily so as to have a greater amplitude. In the case that the lump 55*a*, is thick, is provided to the dome central part 55, however, excessive amplitude of the dome central part 55 is restrained due to the damping effect of the mass effect. Accordingly, the peak of the sound level generated at the time of resonance can be lowered.

Embodiment 3

Next, the structure of the diaphragm of a loud speaker according to Embodiment 3 of the present invention is primarily described in reference to the figures. Here, in the figures of the present invention, the same symbols are attached to the same parts as in Embodiment 1, of which the descriptions are omitted.

Figure 9:
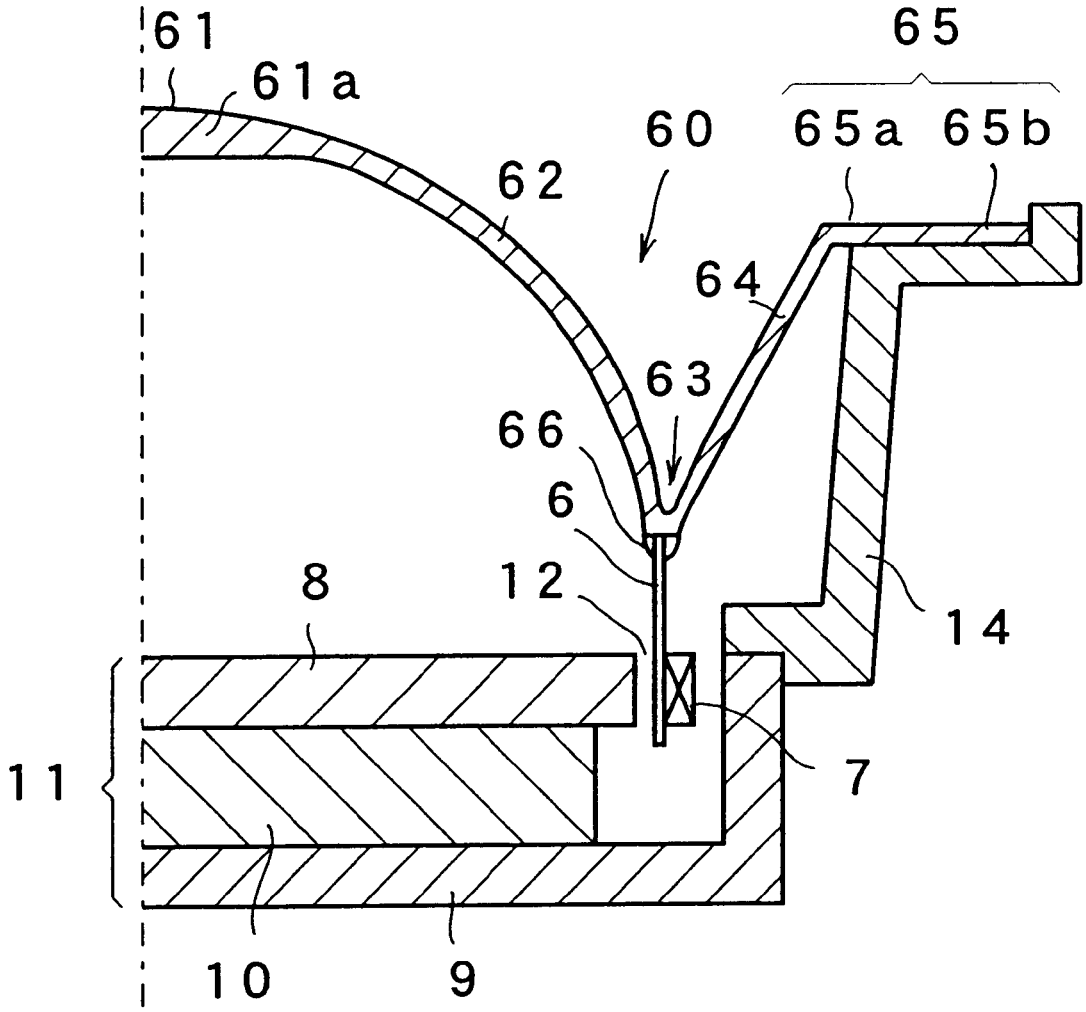
FIG. 9 is a cross section view showing half of the structure of a loud speaker according to Embodiment 3 of the present invention.

FIG. 9 is a cross section view of half of the structure of the loud speaker of the present embodiment. As shown in this figure, this loud speaker is formed to include a voice coil bobbin 6, a voice coil 7, a plate 8, a yoke 9, a magnet 10 as well as a frame 14 and a diaphragm 60, which have a new cross sectional form.

The diaphragm 60 is gained by uniting a dome shaped diaphragm, of which the cross section is of an arc form as shown in FIG. 9, with a cone diaphragm, which includes a portion of a cone. This diaphragm 60 is integrally formed of a dome part 62, which includes a dome central part 61, a voice coil junction part 63, a cone part 64 and a peripheral part 65.

A lump 61*a*, is thick, is formed within concentric circles in the dome central part 61. Though the lump 61*a* of the diaphragm 60 is thick, the remaining parts have an approximately uniform thickness. The voice coil junction part 63 is located at the dome lower end portion. The voice coil bobbin 6 is adhered to the voice coil junction part 63 by using adhesive 66. The cone part 64 is formed in the area from the voice coil junction part 63 to the peripheral part of the diaphragm 60. The cone part 64 has a portion of a cone surface and is a diaphragm which produces an air vibration in the same manner as does the dome part 62. The cone part 64 has a predetermined cone angle relative to the central axis (z axis) of the diaphragm 60.

The peripheral part 65 is integrally formed in the external periphery side of the cone part 64 so as to have surrounds 65*a* and a frame pasting part 65*b*. The dome part 62 and the cone part 64 are held by the frame 14 via the surrounds 65*a* so as to vibrate freely. The frame 14 is longer than the frame 13 shown in FIGS. 4 to 8 in the dimension in the z axis direction. This form gives an offset to the frame pasting surface from the cone part 64.

The thickness of the lump 61*a* is two times, or more, greater than the average thickness of the dome part 62. The thickness of the cone part 64 and the thickness of the peripheral part 65 are equal to the average thickness of the dome part 62.

By providing the cone part 64 in such a manner, the effective area of the diaphragm increases and the sound level can be heightened. When the driving frequency becomes high, the diaphragm 60 resonates so that the amplitude of the dome central part 61 becomes greater. However, since the lump 61*a*, is thick, is formed in the dome central part 61 where the maximum amplitude is created at the time of resonance, the damping effect takes place due to the mass effect thereof. Therefore, the peak of the sound level occurring at the time of resonance can be lowered.

Embodiment 4

Next, the structure of the diaphragm of a loud speaker according to Embodiment 4 of the present invention is primarily described in reference to the drawings. Here, in the present embodiment, the same symbols are attached to the same parts as in Embodiment 1, of which the detailed descriptions are omitted.

Figure 10:
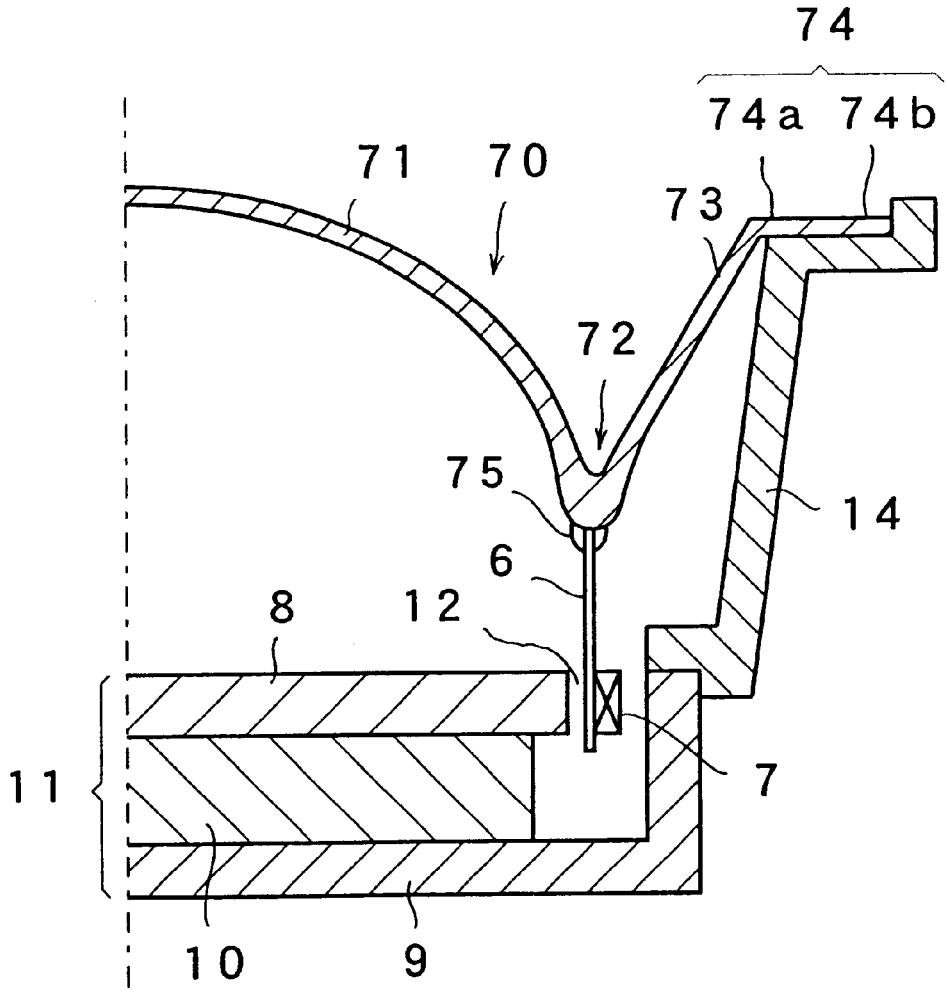
FIG. 10 is a cross section view showing half of the structure of a loud speaker according to Embodiment 4 (part 1) of the present invention.

FIG. 10 is a cross section view showing half of the structure of the loud speaker of the present embodiment. As shown in this figure, this loud speaker is formed to include a voice coil bobbin 6, a voice coil 7, a top plate 8, a yoke 9, a magnet 10, a frame 14 and a diaphragm 70, which has a new cross sectional form.

The diaphragm 70 is gained by uniting a dome shaped diaphragm, of which the cross section is of an arc form as shown in FIG. 10, with a cone diaphragm, which is a portion of a cone. Accordingly, the diaphragm 70 has a form wherein a dome part 71, a voice coil junction part 72, a cone part 73 and peripheral part 74 are co-molded.

The voice coil junction part 72 is located at the lower portion of the dome part 71 and is formed to have a thickness greater than the average thickness of the dome part 71 in the same manner as in Embodiment 2. This is in order to convey the driving force of the voice coil 7 to the diaphragm 70 without fail. The parts other than the voice coil junction part 72 have an approximately uniform thickness.

The voice coil bobbin 6 is attached to the voice coil junction part 72 by using adhesive 75. The cone part 73 is formed in the area from the voice coil junction part 72 to the peripheral part of the diaphragm 70. The cone part 73 is a diaphragm that produces an air vibration in the same manner as does the dome part 71 and has a predetermined cone angle relative to the central axis of the diaphragm 70. The peripheral part 74 is formed in the external peripheral side of the cone part 73 so as to have surrounds 74*a* and a frame pasting part 74*b*. The frame pasting part 74*b* is attached to the frame 14.

According to such a structure, the voice coil bobbin 6 does not become transformed because of the increased rigidity, even in the case that the driving force is increased or in the case that the frequency becomes higher, so that the driving force can be transmitted to the diaphragm 70 without fail.

Figure 11:
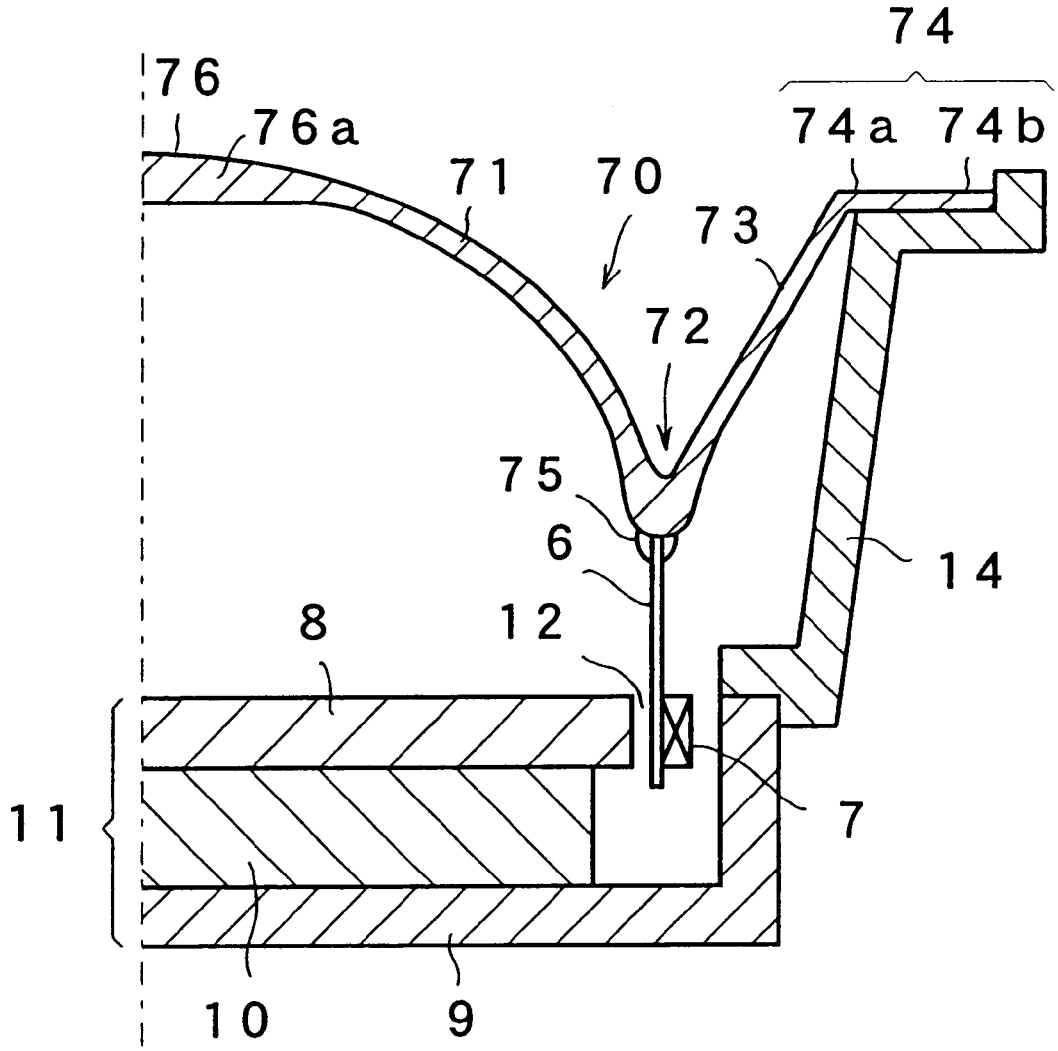
FIG. 11 is a cross section view showing half of the structure of a loud speaker according to Embodiment 4 (part 2) of the present invention.

FIG. 11 shows an example wherein the dome central part 76 of the diaphragm 70 is made to have a great thickness in addition to the above thickening of the voice coil junction part. Here, a lump 76*a*, is thick, within concentric circles is provided in the dome central part 76 of the diaphragm 70. When the driving frequency becomes higher, the diaphragm 70 resonates so that the amplitude of the dome central part 76 becomes greater. However, since the lump 76*a*, is thick, is formed in the dome central part 76, the damping effect takes place due to the mass effect thereof. Therefore, the peak of the sound level, which occurs at the time of resonance, can be lowered.

Embodiment 5

Next, the structure of the diaphragm of a loud speaker according to Embodiment 5 of the present invention is primarily described in reference to the drawings. Here, in the present embodiment, the same symbols are attached to the same parts as in Embodiment 1, of which the detailed descriptions are omitted.

Figure 12:
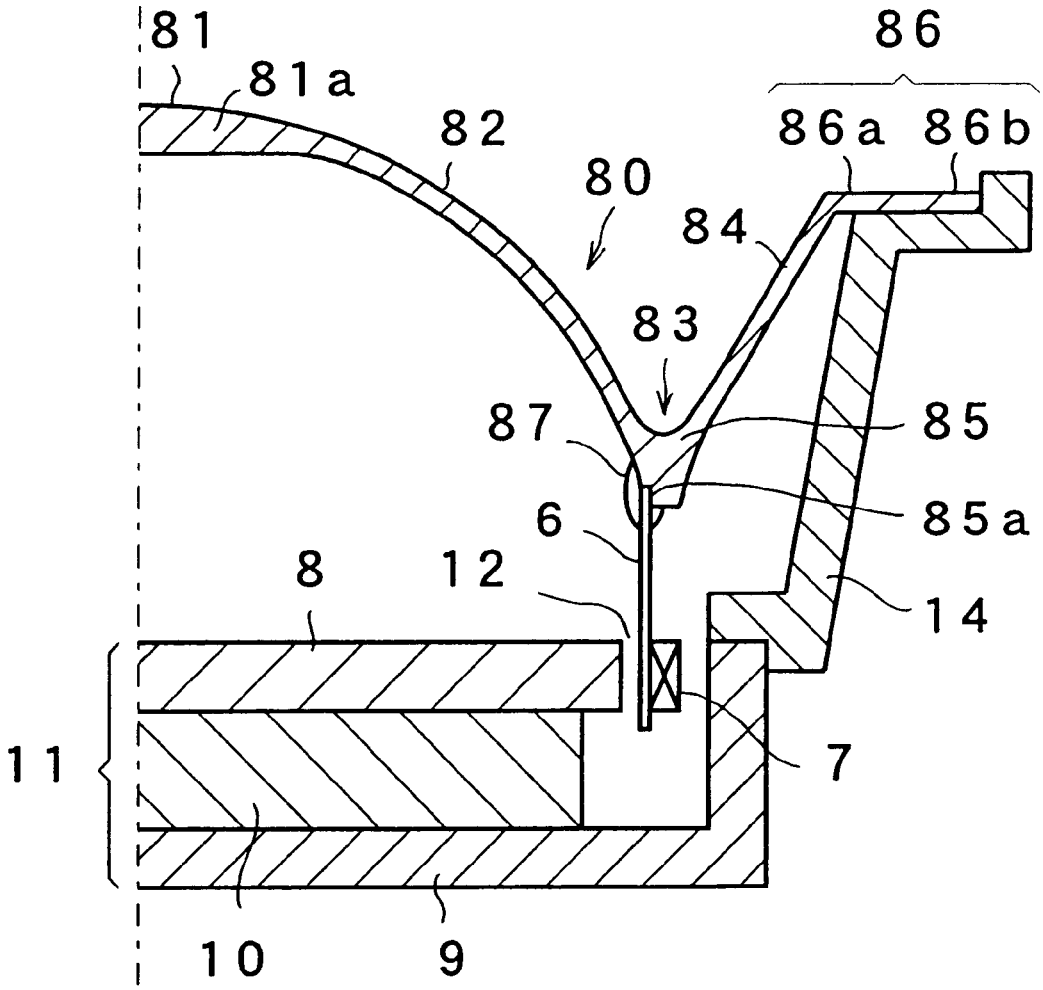
FIG. 12 is a cross section view showing half of the structure of a loud speaker according to Embodiment 5 of the present invention.

FIG. 12 is a cross section view showing half of the structure of the loud speaker according to the present embodiment. As shown in this figure, this loud speaker is formed to include a voice coil bobbin 6, a voice coil 7, a plate 8, a yoke 9, a magnet 10, a frame 14 and a diaphragm 80, which has a new cross sectional form.

The diaphragm 80 is gained by uniting a dome shaped diaphragm, of which the cross section is of an arc form, with a cone diaphragm, which is a portion of a cone. The diaphragm 80 is integrally formed of a dome part 82 which includes a dome central part 81, a voice coil junction part 83, a cone part 84, an annular rib 85 and a peripheral part 86.

The dome central part 81 has a lump 81*a* which is formed so as to have a thickness greater than the average thickness of the dome part 82. This is in order to reduce resonance of the dome part 82. The annular rib 85 protrudes from the voice coil junction part 83 toward the voice coil and has a level difference 85*a*. The level difference 85*a* part is engaged with the outer diameter part or the inner diameter part of the voice coil bobbin 6 so as to enhance the adhesion of the voice coil bobbin 6 to the diaphragm 80 and so as to improve the positioning accuracy (coaxial accuracy) of the voice coil bobbin 6 relative to the diaphragm 80. Therefore, the driving force of the voice coil 7 is transmitted to the voice coil junction part 83 without fail. Though, in FIG. 12, the level difference 85*a* of the annular rib 85 is provided in a position where the outer diameter part of the voice coil bobbin 6 is engaged, it may be provided in a position where the inner diameter part of the voice coil bobbin 6 is engaged. In addition, the annular rib 85 is provided with a recess instead of the level difference 85*a* in order to hold, across the thickness direction, the voice coil bobbin 6. Though, the lump 81*a* of the dome central part 81 is thick, the parts other than that have an approximately uniform thickness.

The voice coil bobbin 6 is attached to the level difference 85*a* part of the annular rib 85 by using adhesive 87. The cone part 84 is formed in the area from the voice coil junction part 83 to the peripheral part of the diaphragm 80. The cone part 84 is a diaphragm, which creates an air vibration in the same manner as the dome part 82, and has a predetermined cone angle relative to the central axis of the diaphragm 80. The peripheral part 86 is formed in the external peripheral side of the cone part 84 so as to have surrounds 86*a* and a frame pasting part 86*b*. The diaphragm 80 is held by the frame 14 via the surrounds 86*a* so as to vibrate freely.

When the driving frequency becomes high, the amplitude in the dome central part 81 tends to become larger than in the other parts of the diaphragm 80 due to resonance. However, since the lump 81*a* formed in the dome central part 81 is thick, the damping effect works due to the mass effect. Therefore, the peak of the sound level, which occurs at the time of resonance, can be lowered.

Furthermore, since the contact area of the voice coil bobbin 6 with the voice coil junction part 83 increases because of the annular rib 85, the reinforcement effect of the voice coil bobbin 6 can be gained. Therefore, the voice coil bobbin 6 is not transformed, because of the increased rigidity, even in the case that the driving forces is increased or in the case that the driving frequency becomes higher, so that the driving force can be transmitted to the diaphragm 80 without fail.

Embodiment 6

Next, the structure of the diaphragm of a loud speaker according to Embodiment 6 of the present invention is primarily described in reference to the drawings. Here, in the present embodiment, the same symbols are attached to the same parts has in Embodiment 1, of which the detailed descriptions are omitted.

Figure 13:
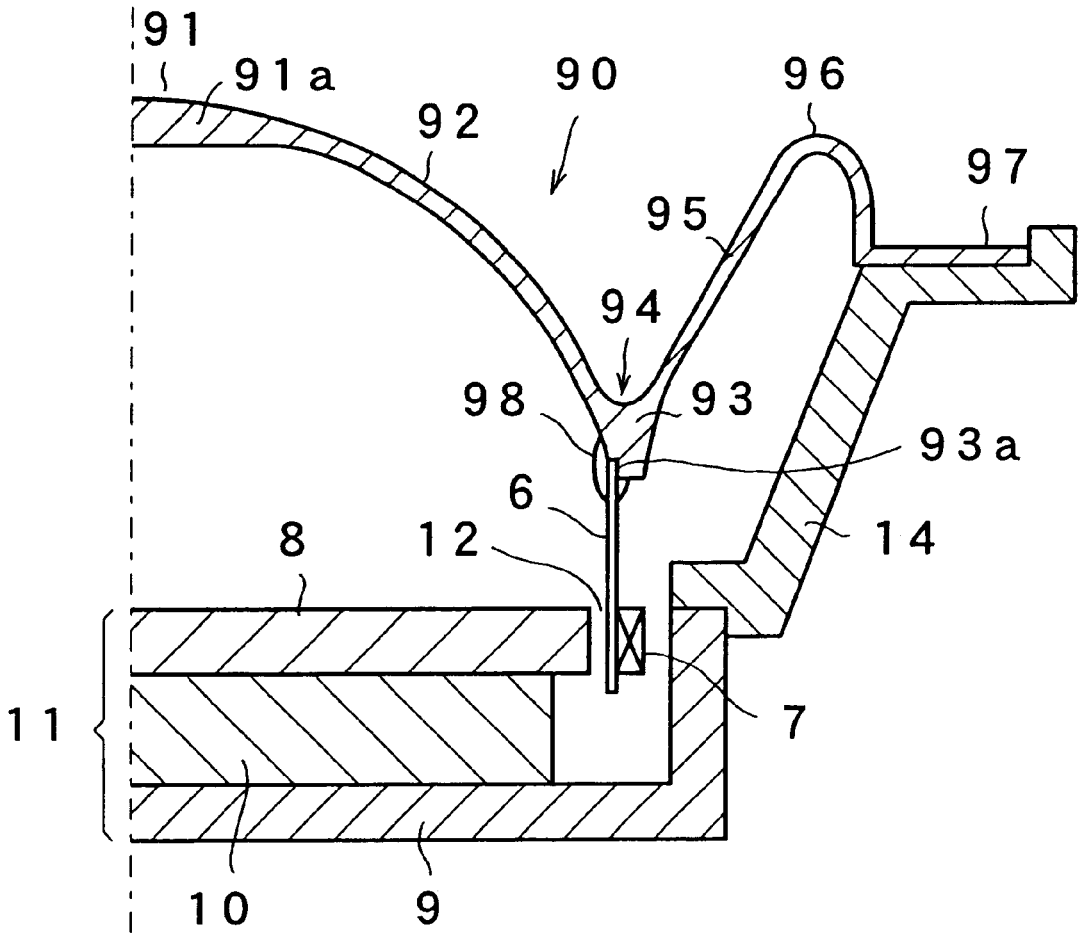
FIG. 13 is a cross section view showing half of the structure of a loud speaker according to Embodiment 6 (part 1) of the present invention.

FIG. 13 is a cross section view showing half of the structure of the loud speaker of the present embodiment. As shown in this figure, this loud speaker is formed to include a voice coil bobbin 6, a voice coil 7, a plate 8, a yoke 9, a magnet 10, a frame 14 and a diaphragm 90, which has a new cross sectional form.

The diaphragm 90 is gained by uniting a dome shaped diaphragm, of which the cross section is of an arc form, with a cone diaphragm, which is a portion of a cone. The diaphragm 90 is integrally formed of a dome part 92 which includes the dome central part 91, the voice coil junction part 94 which includes the annular rib 93, a cone part 95, roll-surrounds 96 and a frame pasting part 97.

The dome central part 91 has a lump 91*a* which is formed thicker than the average thickness of the dome part 92. This is in order to reduce resonance of the dome part 92. The annular rib 93 protrudes from the voice coil junction part 94 toward the voice coil and has a level difference 93*a*. The level difference 93*a* is engaged with the outer diameter part or the inner diameter part of the voice coil bobbin 6 so as to enhance the adhesion of the voice coil bobbin 6 to the diaphragm 90 and so as to increase the positioning accuracy of the voice coil bobbin 6 with respect to the diaphragm 90. Therefore, the driving force of the voice coil 6 is transmitted to the voice coil junction part 94 without fail.

The voice coil bobbin 6 is attached to the level difference 93*a* of the annular rib 93 by using adhesive 98. The cone part 95 is formed in the area from the voice coil junction part 94 to the peripheral part of the diaphragm 90. The cone part 95 is a diaphragm which produces an air vibration in the same manner as the dome part 92 and has a predetermined cone angle relative to the central axis of the diaphragm 90. The roll-surrounds 96 are formed around the external periphery of the cone part 95. The roll-surrounds 96 elastically support the diaphragm 90 relative to the frame 14 when the dome part 92 and the cone part 95, which are main elements of the diaphragm 90, vibrate. The roll-surrounds 96 of this structure works to increase the low frequency sound reproduction ability of the loud speaker, in comparison with the surrounds in a plane form of Embodiments 1 to 5. The frame pasting part 97 is formed in the peripheral part of the roll-surrounds 96 and is attached to the frame 14. The diaphragm 90 has an approximately uniform thickness except for the voice coil junction part 94, though the lump 91*a* part is thick. Here, the part, which includes the roll-surrounds 96 and the frame pasting part 97, is referred to as a peripheral part in the same manner as in the cases of Embodiments 1 to 5. In the descriptions below, the part of the diaphragm, which does not directly contribute to an air vibration, is referred to as a peripheral part.

Though, when the driving frequency becomes high, the amplitude of the dome central part 91 of the diaphragm 90 tends to become greater than the other parts due to resonance, the lump 91*a* of the thickness is formed in the dome central part 91 and, therefore, the damping effect works due to mass effect. Therefore, the peak of the sound level, which occurs at the time of resonance, can be lowered.

Figure 14:
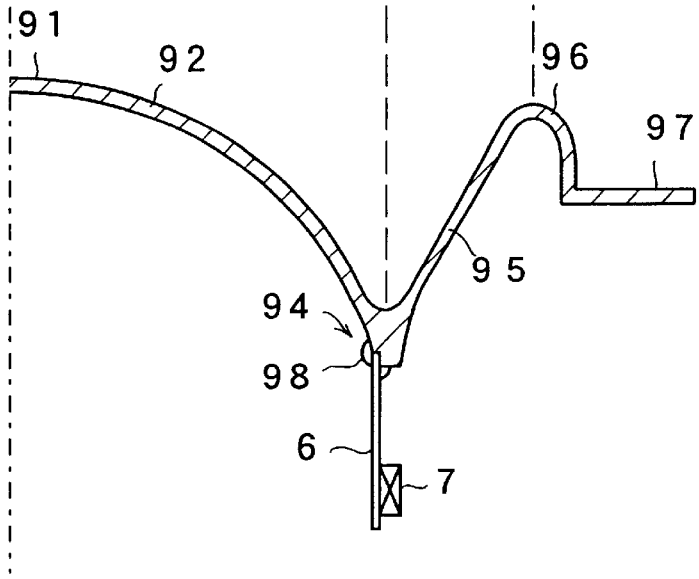
FIG. 14 is a cross section view showing half of the structure of a loud speaker according to Embodiment 6 (part 2) of the present invention.

FIG. 14 is a cross section view partially showing an example where no lump is provided in the dome central part 91 of the diaphragm 90 in the present embodiment. In any case, since the contact area of the voice coil bobbin 6 with the voice coil junction part 94 increases due to the annular rib 93, a reinforcement effect of the voice coil bobbin 6 occurs. Hence, the voice coil bobbin 6 is not deformed due to the increased rigidity, even in the case that the driving force is increased or in the case that the driving frequency becomes high so that the driving force can be transmitted to the diaphragm 90 without fail.

In addition, by providing the roll-surrounds 96, the stiffness of the diaphragm 90 in comparison with the voice coil bobbin 6 is reduced. Accordingly, reproduction ability of the middle frequency region is increased, even of the high frequency reproduction loud speaker.

Embodiment 7

Figure 15:
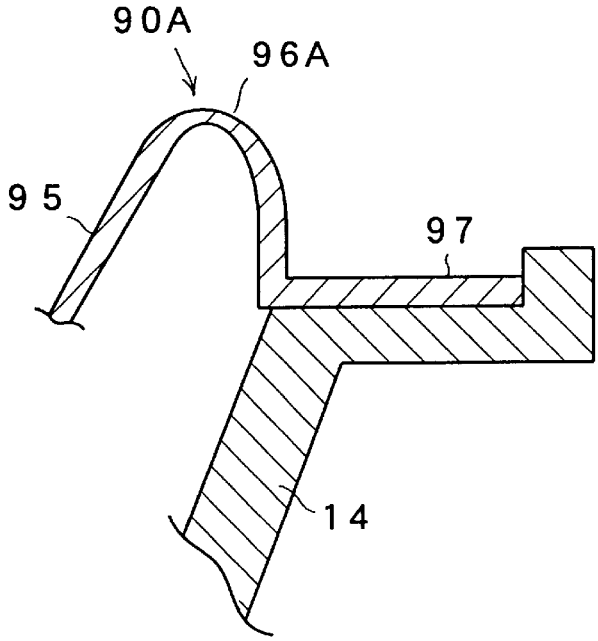
FIG. 15 is a cross section view showing half of the structure of a loud speaker according to Embodiment 7 of the present invention.

Next, the structure of the diaphragm of the loud speaker according to Embodiment 7 of the present invention is primarily described in reference to FIG. 15. FIG. 15 is a cross section view showing the structure of a main part of a diaphragm. Here, in FIG. 15 of the present embodiment, only the parts different from those in Embodiment 6 are illustrated and the same parts are not shown in the figure.

The diaphragm 90A according to the present embodiment is integrally formed of a dome part 92, a cone part 95, roll-surroundings 96A and a frame pasting part 97 in the same manner as shown in FIG. 14. The thickness of the roll-surrounds 96A is small in comparison with the average thickness of the diaphragm 90A. Thus, stiffness of the diaphragm 90A in the case that it is compared with the voice coil bobbin 6 is further reduced. Accordingly, the middle frequency sound reproduction ability is further increased even in a loud speaker for high frequency sound reproduction.

Embodiment 8

The structure of the diaphragm of a loud speaker according to Embodiment 8 of the present invention is primarily described. The loud speaker of the present embodiment is characterized in that the effective radiation area for the sound in the dome part and the effective radiation area for the sound in the cone part are approximately equal to each other while the remaining parts are the same as in the loud speakers of Embodiments 3 to 7.

Figure 16:
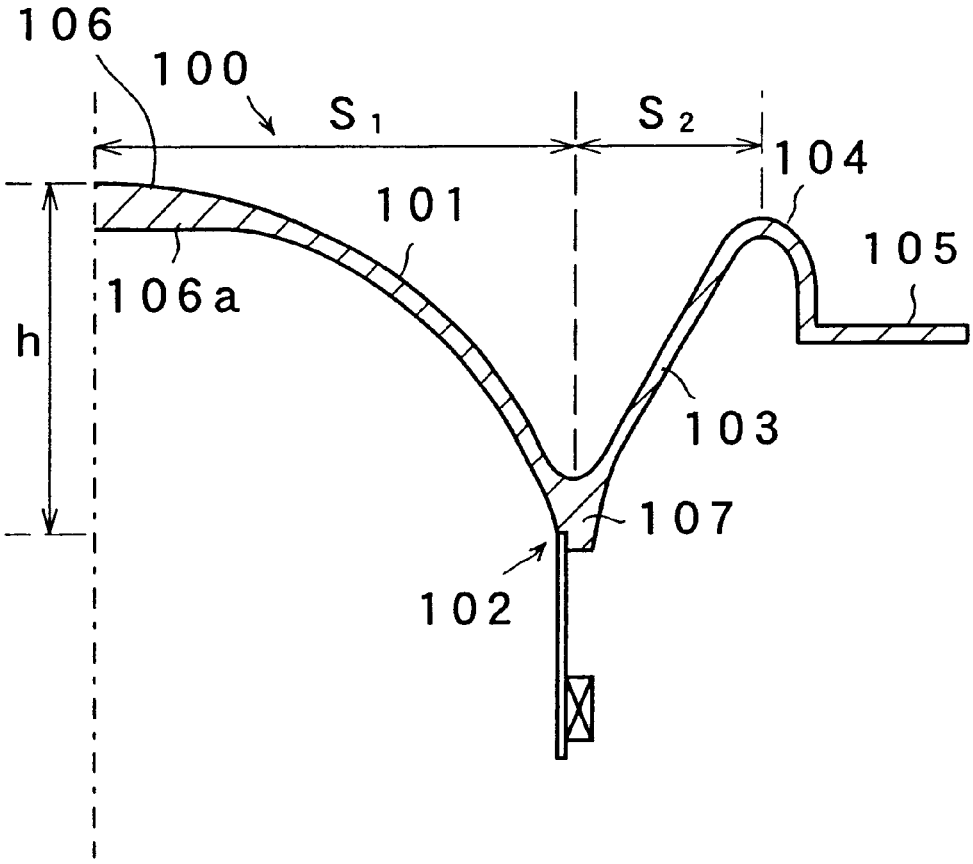
FIG. 16 is a cross section view showing half of the structure of a loud speaker according to Embodiment 8 of the present invention.

FIG. 16 is a cross section view showing only half of the diaphragm portion of the loud speaker according to the present embodiment. The basic structure of the diaphragm 100 is similar to that shown in Embodiment 6 or 7. This diaphragm 100 is integrally formed of a dome part 101, a voice coil conjunction part 102, a cone part 103, roll-surrounds 104 and a frame pasting part 105. The center of the dome part 101 is referred to as a dome central part 106. A lump 106*a* of the thickness is formed in the dome central part 106. An annular rib 107 is formed in the voice coil junction part 102.

In particular, the radiation area S1 of the dome part 101 and the radiation area S2 of the cone part 103 are made to be approximately equal to each other in the present embodiment. The radiation area S2 of the cone part 103 is an effective radiation area that includes half of the inside of the roll-surrounds 104. In the region where the frequency is high, the resonant frequency of the dome part 101 alone is set to be approximately 1.2 to 2 times higher than the resonant frequency of the cone part 103 alone.

Figure 17:
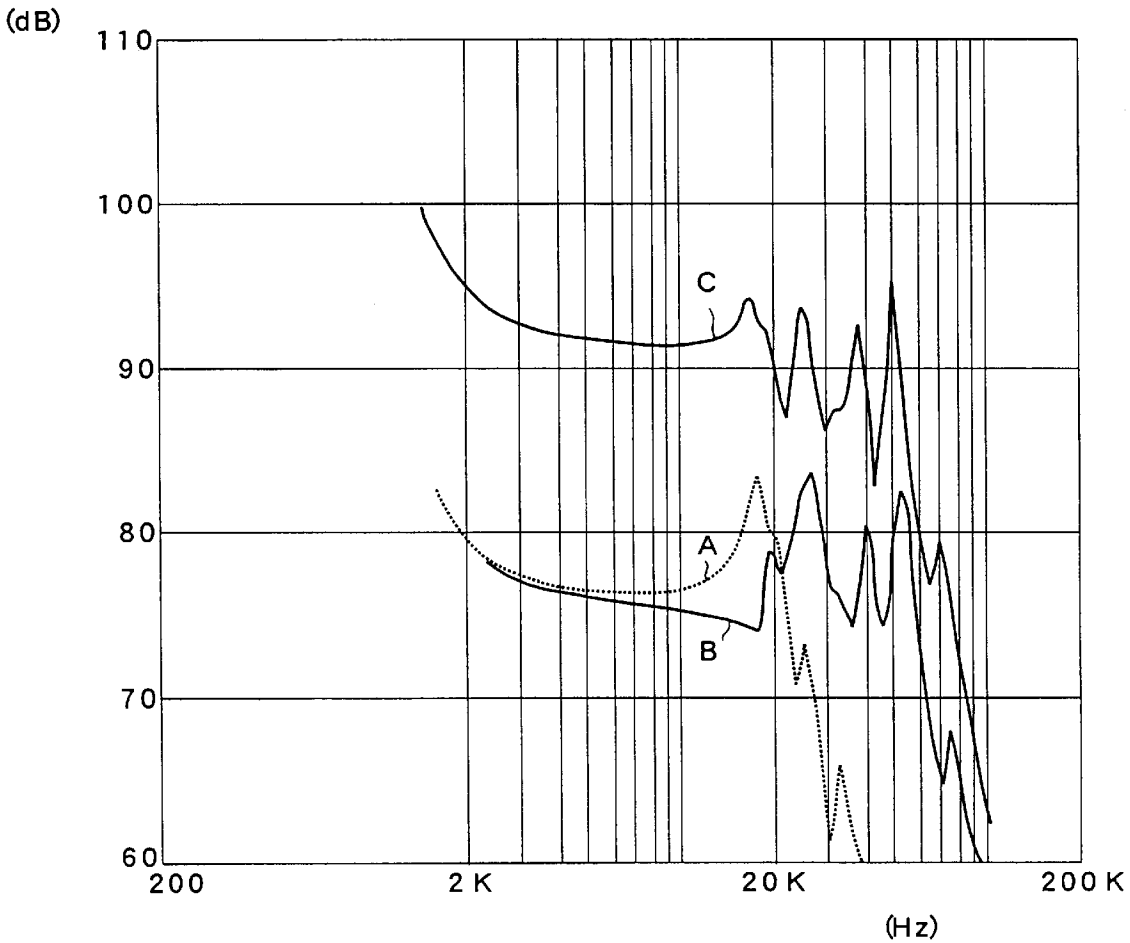
FIG. 17 is a characteristics graph showing the analysis result of the sound pressure level vs. frequency characteristic of the loud speaker according to Embodiment 8.

The frequency characteristics of the loud speaker formed in the above manner are described. FIG. 17 shows a characteristic graph where the sound pressure level vs. frequency characteristic of the loud speaker is calculated for each portion by means of a finite element method. Curve A in the figure shows the sound pressure level vs. frequency characteristics of the cone part 103. Curve B shows the sound pressure level vs. frequency characteristics of the dome part 101. Curve C shows the overall sound frequency characteristics of the combination of the cone part 103 and the dome part 101. Here, curves A and B show the lowering of the sound levels by 10 dB, respectively. As can be understood from curve A, the resonant point of the cone part 103 is approximately at 18 kHz so as to generate a peak which is approximately 10 dB higher than the average level of 10 kHz. In addition, the sound level gradually increases as the frequency becomes higher in the frequency range lower than the resonating point.

On the other hand, the main resonating point of the dome part 101 is in 28 kHz which generates a peak 10 dB higher than the level in the vicinity of 10 kHz. Furthermore, it is understood that the sound level gradually lowers as the frequency becomes higher in the lower frequency range where resonance occurs. In this example, the resonant frequency of the dome part 101 is 1.6 times higher than the resonant frequency of the cone part 103. The sound from the cone part 103 and the sound from the dome part 101 are reproduced so as to have the same phase in the frequency range lower than the resonant frequency and, therefore, the sound pressure level vs. frequency characteristics of the total characteristics (curve C) become flat. The resonant peak of the cone part 103 is offset by the dip immediately before the resonant frequency of the dome part 101 because this frequency is high.

As described above, in the loud speaker of the present embodiment, the effective radiation areas S1 and S2 are approximately equal and the peak and the dip due to the resonance occurring at a high frequency can be offset each other. Hence, the sound pressure level vs. frequency characteristics in the high frequency range can be flattened. In the case that the effective radiation areas vary to a great degree, the sound levels to be offset become different and the frequency characteristics deteriorate due to the effects of the characteristics of the portion having a large area. In addition, in the case that the resonant frequencies are different of a magnitude of twice, or greater, the frequencies where the peak and the dip occur greatly differ from each other and there is a tendency for the sound pressure level vs. frequency characteristics to deteriorate.

Embodiment 9

Next, the structure of the diaphragm of a loud speaker according to Embodiment 9 of the present invention is primarily described in reference to the drawings. Here, in the present embodiment, the same symbols are attached to the same parts as in Embodiment 1.

Figure 18:
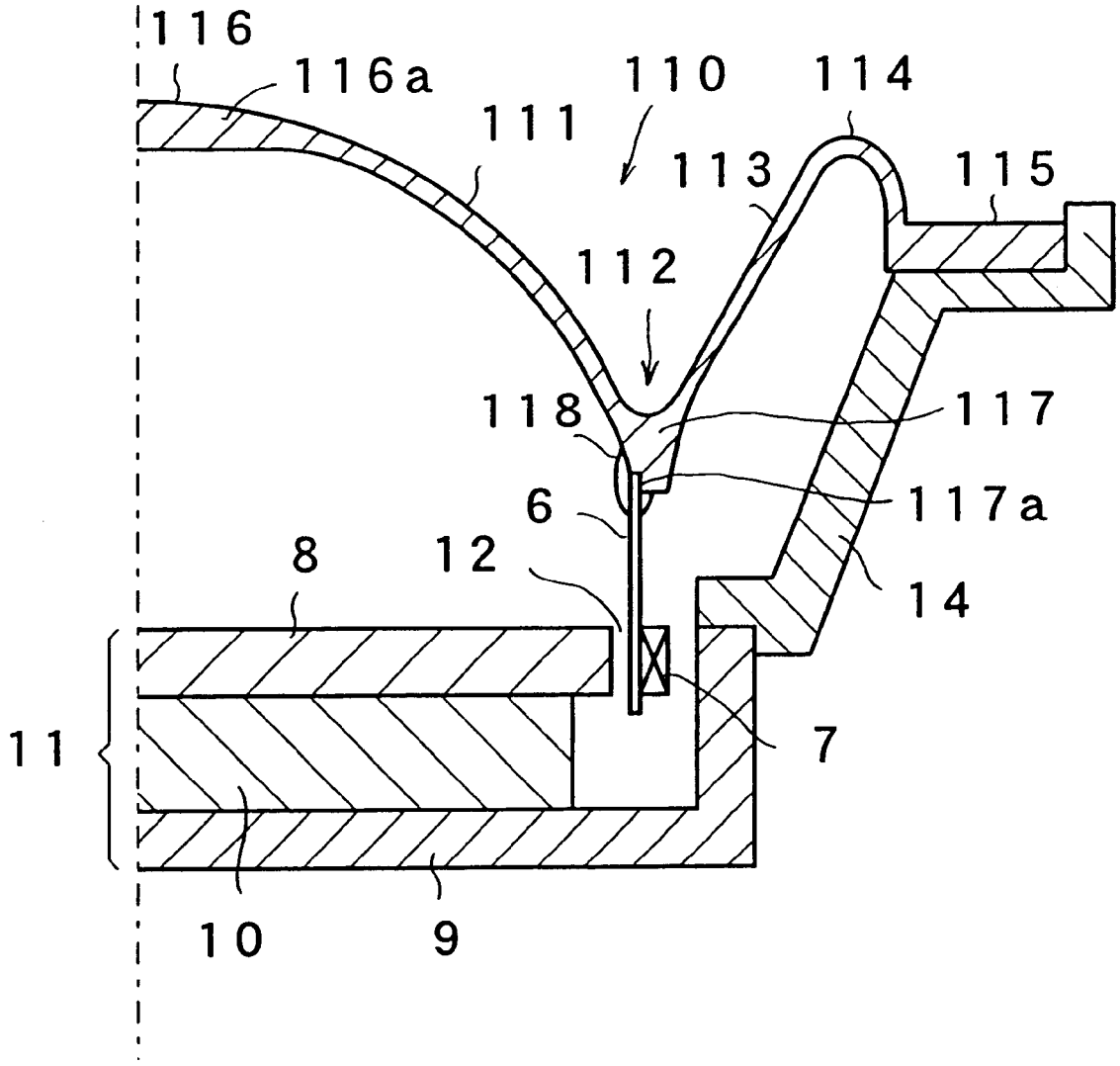
FIG. 18 is a cross section view showing half of the structure of a loud speaker according to Embodiment 9 of the present invention.

FIG. 18 is a cross section view showing half of the structure of the loud speaker according to the present embodiment. As shown in this figure, this loud speaker is formed to include a voice coil bobbin 6, a voice coil 7, a plate 8, a yoke 9, a magnet 10, a frame 14 and a diaphragm 110, which has a new cross sectional form.

The diaphragm 110 is gained by uniting a dome shaped diaphragm, of which the cross section is of an arc form, with a cone diaphragm, which is a portion of a cone. The diaphragm 110 is integrally formed of a dome part 111, a voice coil junction part 112, a cone part 113, roll-surrounds 114 and a frame pasting part 115. The center of the dome part 111 is referred to as a dome central part 116.

The dome central part 116 has a lump 116*a* which his formed so as to have a thickness greater than the average thickness of the dome part 111. This is in order to reduce resonance of the dome part 111. The annular rib 117 protrudes from the voice coil junction part 112 to the voice coil side and has a level difference 117*a*. The level difference 117*a* is engaged with the outer diameter part or the inner diameter part of the voice coil bobbin 6 so as to enhance the adhesion of the voice coil bobbin 6 to the diaphragm 110 and so as to increase the positioning accuracy of the voice coil bobbin 6 relative to the diaphragm 110.

The voice coil bobbin 6 is attached to the level difference 117*a* of the annular rib 117 by using adhesive 118. The cone part 113 is formed in the area from the voice coil junction part 112 to the peripheral part of the diaphragm 110. The cone part 113 is a diaphragm which produces an air vibration in the same manner as the dome part 111 and has a predetermined cone angle relative to the central axis of the diaphragm 110. The roll-surrounds 114 is formed around the external periphery of the cone part 113. The roll-surrounds 114 elastically support the dome part 111 and the cone part 113, which are the main elements of the diaphragm 110, relative to the frame 114.

The frame pasting part 115 is formed in the peripheral part of the roll-surrounds 114. In the present embodiment, the frame pasting part 115 is formed so that the thickness thereof is sufficiently greater than the average thickness of the diaphragm 110. The diaphragm 110 is held by the frame 14 via the roll-surrounds 114 so as to vibrate freely.

In the case that the thickness of the frame pasting part 115 is made to be two times, or more, thicker than the average thickness of the diaphragm 110, curvature or twist can be prevented from occurring at the time of resin formation of the diaphragm 110 so that the dimensional accuracy of the finish of the diaphragm 110 becomes high. Accordingly, gap defects where the voice coil 6 contacts the plate within the annular magnetic gap 12 or the increase of the formation distortion of the products can be prevented so that the production efficiency of the diaphragm can be increased. Though, in the present embodiment, the lump 116*a* of the thickness is provided in the dome central part 116 of the diaphragm 110, the diaphragm may have a uniform thickness.

Embodiment 10

Next, the structure of the diaphragm of a loud speaker according to Embodiment 10 of the present invention is primarily described in reference to the drawings. Here, the present embodiment is described by attaching the same symbols to the same parts as in Embodiment 1.

Figure 19:
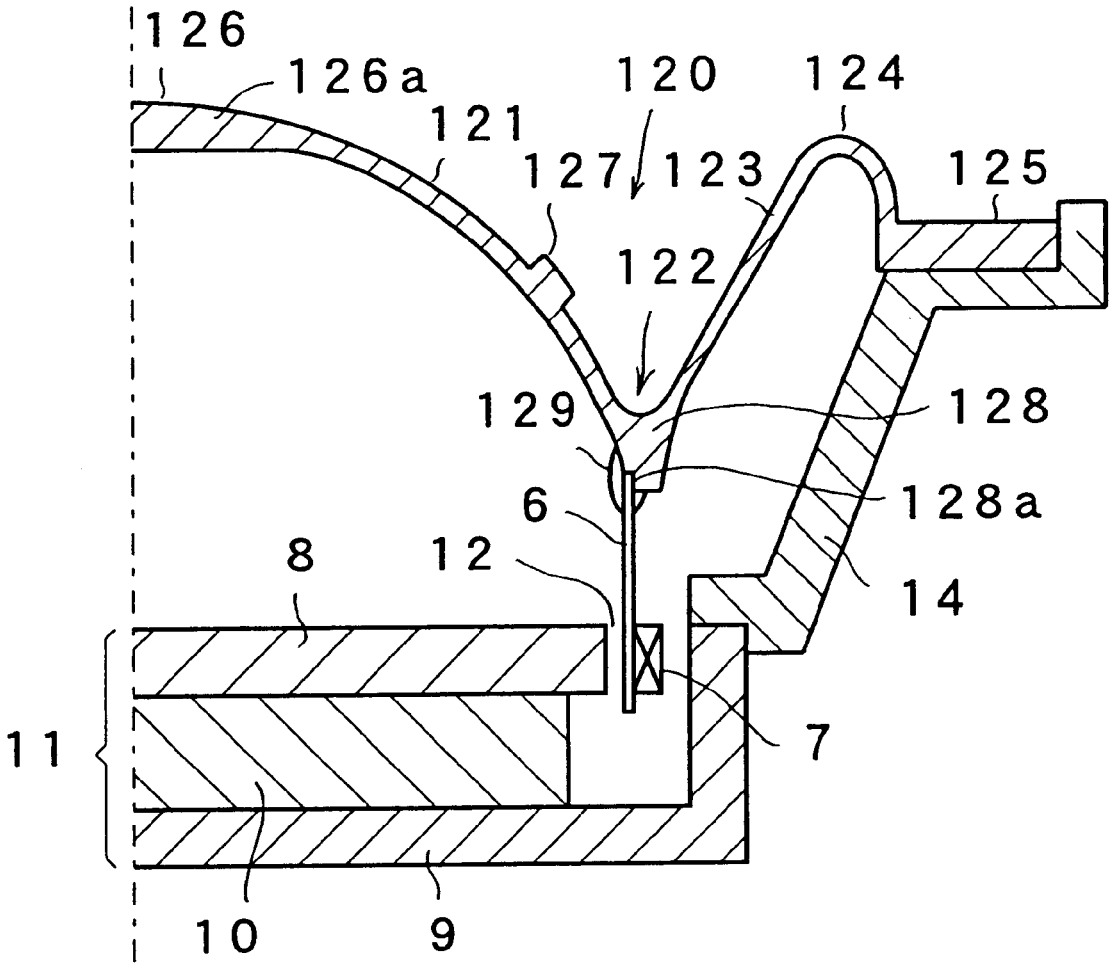
FIG. 19 is a cross section view showing half of the structure of a loud speaker according to Embodiment 10 of the present invention.

FIG. 19 is a cross section view showing half of the structure of the loud speaker according to the present embodiment. As shown in this figure, this loud speaker is formed to include a voice coil bobbin 6, a voice coil 7, a plate 8, a yoke 9, a magnet 10, a frame 14 and a diaphragm 120, which has a new cross sectional form.

The diaphragm 120 is gained by uniting a dome shaped diaphragm, of which the cross section is of an arc form, with a cone diaphragm, which is a portion of a cone. The diaphragm 120 is integrally formed of a dome part 121, a voice coil junction part 122, a cone part 123, roll-surrounds 124 and a frame pasting part 125.

The dome part 121 includes a dome central part 126 and a dome rib part 127. An annular rib 128 is formed in the voice coil junction part 122. The dome central part 126 has a lump 126*a* of which the thickness is greater than the average thickness of the dome part 121. The dome rib part 127 is formed of a portion of the dome part 121 that protrudes toward the outside in a convex form.

Figure 20:
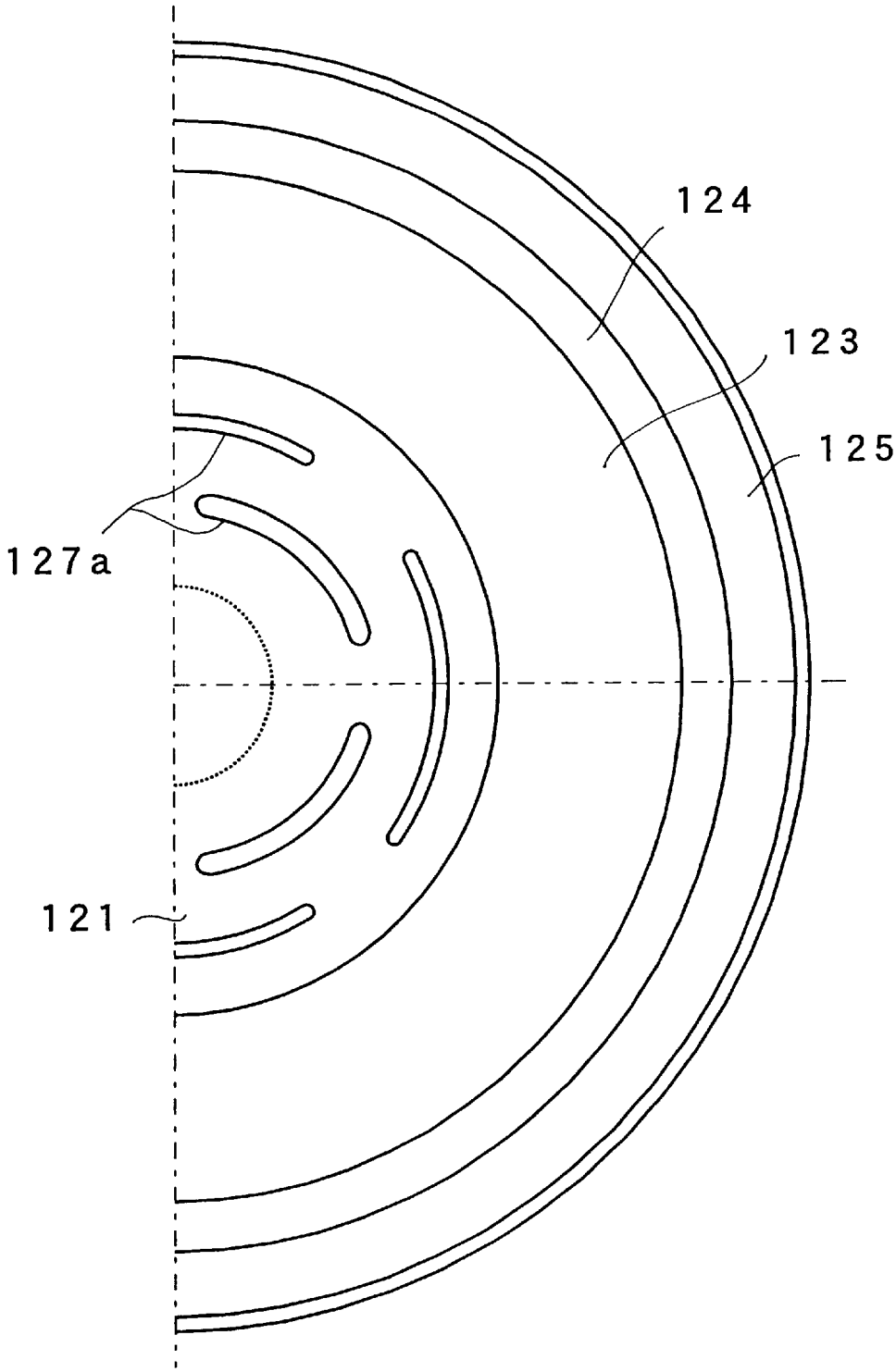
FIG. 20 is a plan view showing the structure of a diaphragm (part 1) of the loud speaker according to Embodiment 10.
Figure 21:
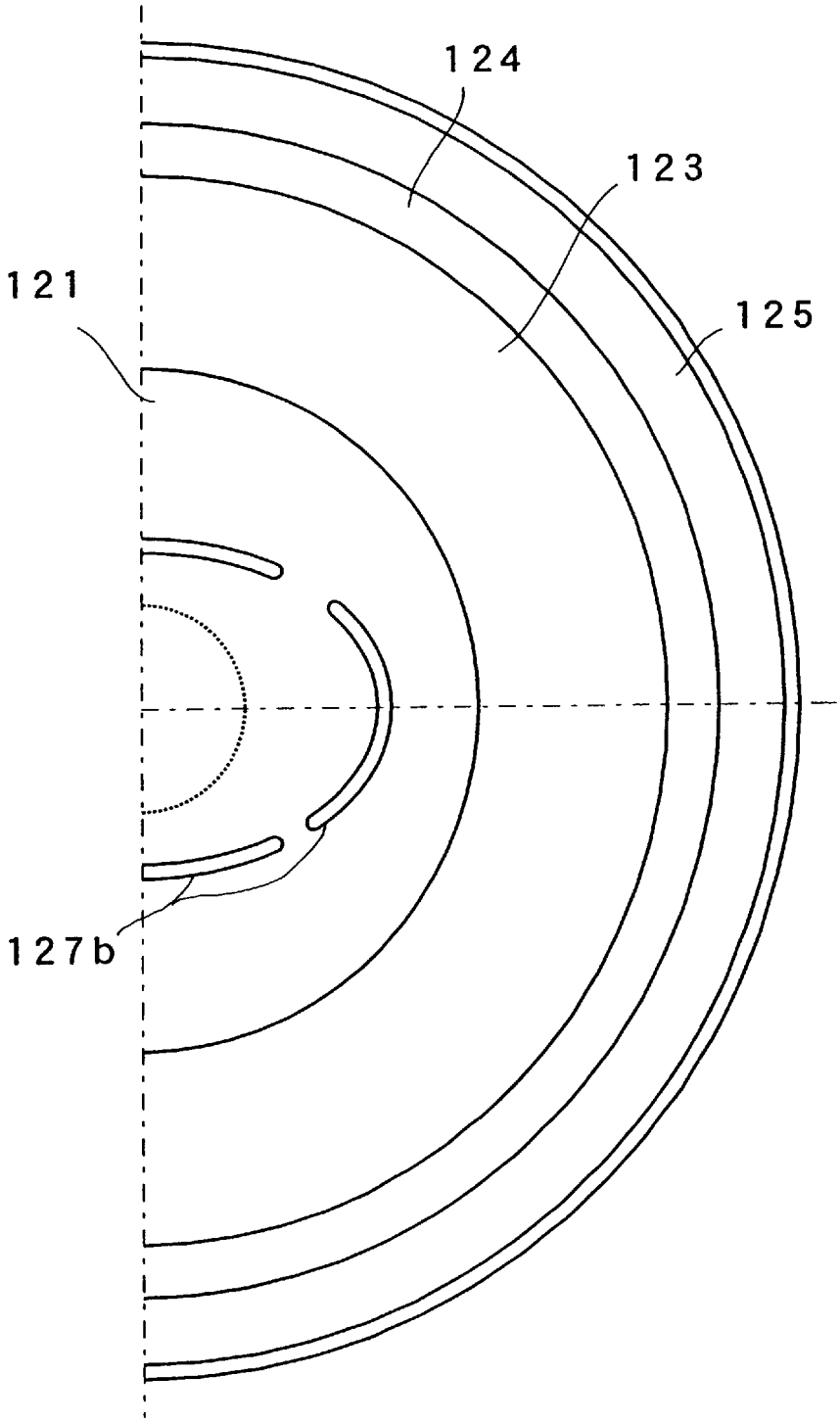
FIG. 21 is a plan view showing the structure of a diaphragm (part 2) of the loud speaker according to Embodiment 10.

FIG. 20 is a plan view showing the structural example (part 1) of the diaphragm 120 according to the present embodiment and shows the right half of the diaphragm. The dome rib parts 127*a* shown in FIG. 20 are convex portions in arc forms arranged in a concentric manner. FIG. 21 is a plan view showing a structural example (part 2) of the diaphragm 120 according to the present embodiment and shows the right half of the diaphragm. The dome rib parts 127*b* shown in FIG. 21 are convex portions in elliptical arc forms arranged in an elliptical manner. Such dome rib parts 127 have a thickness 1.5 times, or greater, than the average thickness of the diaphragm 120.

An annular rib 128 shown in FIG. 19 protrudes from the voice coil junction part 122 toward the voice coil and has a level difference 128*a*. The level difference 128*a* is engaged with the outer diameter part or the inner diameter part of the voice coil bobbin 6 so as to enhance the adhesion of the voice coil bobbin 6 to the diaphragm 110 and so as to increase the positioning accuracy of the voice coil bobbin 6 relative to the diaphragm 120.

The voice coil bobbin 6 is attached to the level difference 128*a* of the annular rib 128 by using adhesive 129. The cone part 123 is formed in the area from the voice coil junction part 122 to the peripheral part of the diaphragm 120. The cone part 123 is a diaphragm that produces an air vibration in the same manner as does the dome part 121 and has a predetermined cone angle relative to the central axis of the diaphragm 120. The roll-surrounds 124 are formed around the external periphery of the cone part 123. The roll-surrounds 124 elastically support the dome part 121 and the cone part 123, which are the main elements of the diaphragm 120, so as to cause vibration.

The frame pasting part 125 is formed in the peripheral part of the roll-surrounds 124. The frame pasting part 125 is formed so that the thickness thereof is, sufficiently, greater than the average thickness of the diaphragm 120. The frame 14 via the frame pasting part 125 supports the diaphragm 120.

When the driving frequency becomes high, the amplitude of the dome central part 126 tends to become larger than the other parts. However, since the lump 126*a*, of which the thickness is great, is formed in the dome central part 126, the damping effect, due to the mass effect thereof, occurs. Therefore, the peak of the sound level, which occurs at the time of resonance of the dome part 121, can be lowered. Furthermore, when the driving frequency becomes high, a high order resonance mode occurs so that the frequency characteristics of the sound level are disturbed.

Figure 22:
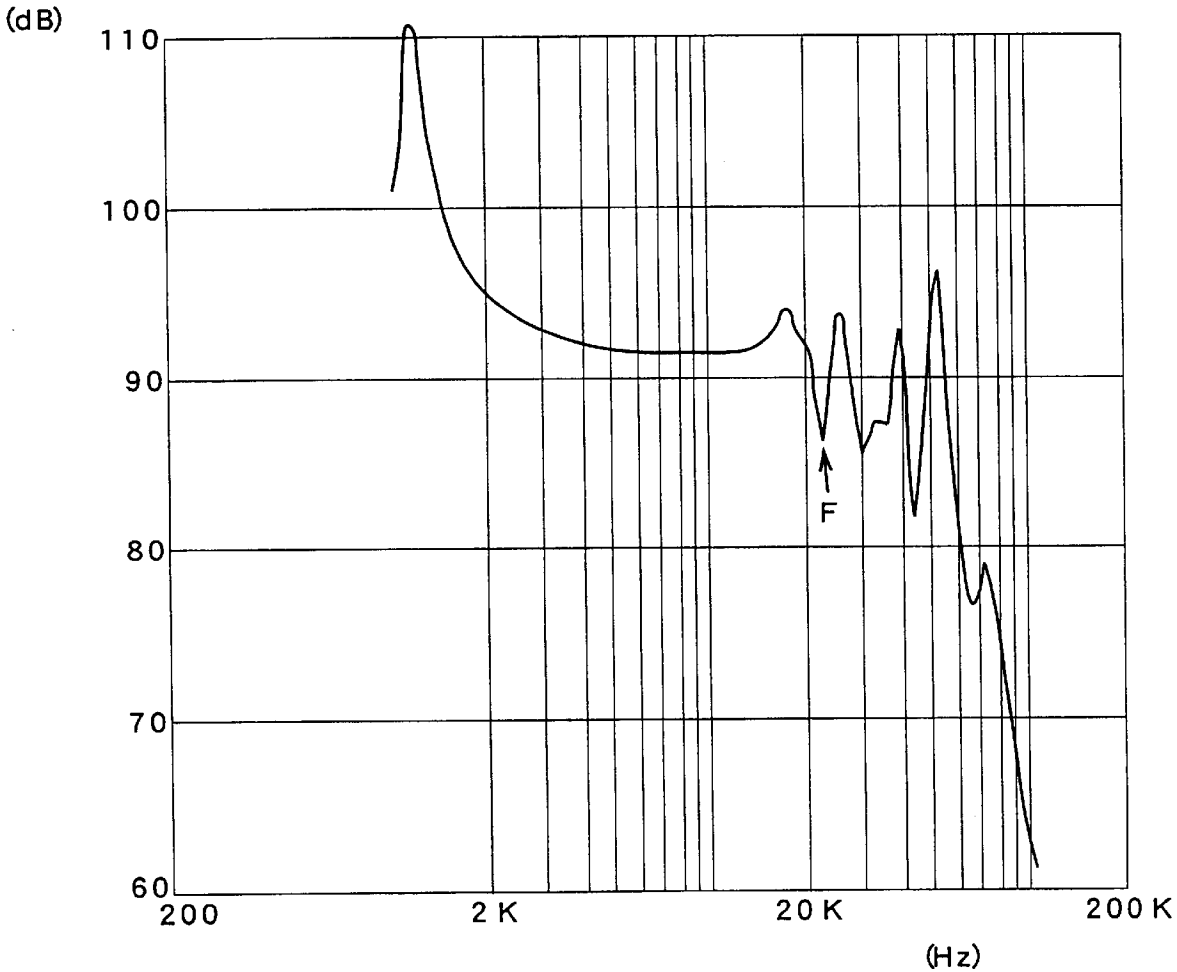
FIG. 22 is a characteristics graph showing the analysis result of the sound pressure level vs. frequency characteristic of the loud speaker according to Embodiment 10.

FIG. 22 shows the sound pressure level vs. frequency characteristics in the case that there are no dome rib parts. It is understood that though the peak in the cone part 123 due to the primary resonance is low, the dip of the dome part 121 due to a resonance mode is generated at the frequency F.

Figure 23:
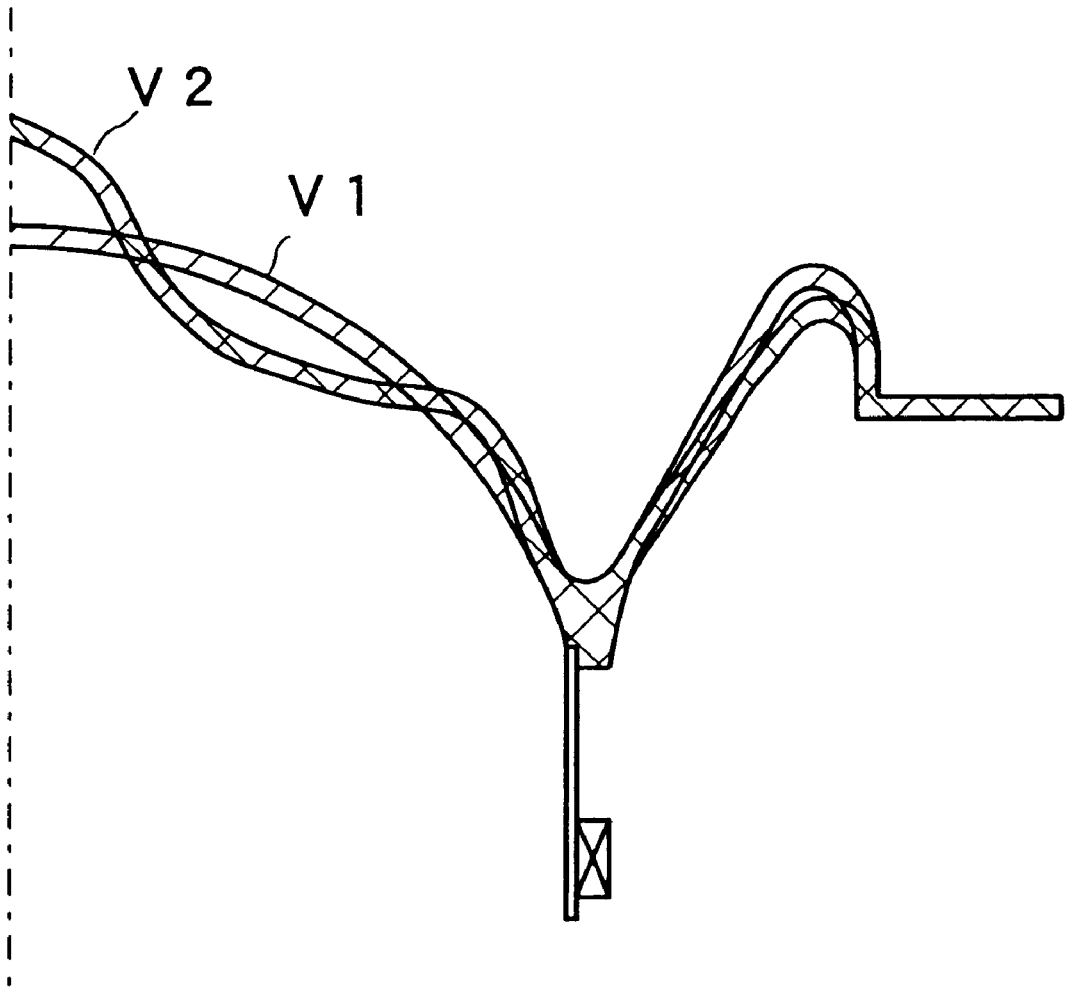
FIG. 23 is an explanatory view of a vibration mode of the diaphragm of the loud speaker according to Embodiment 10.

FIG. 23 is a schematic diagram representing a vibration mode of the diaphragm analyzed by means of a finite element method. When the frequency becomes F of FIG. 22, the resonance mode of the diaphragm becomes as in FIG. 23. It is understood that the amplitudes in the vicinity of the dome central part and in the vicinity of the dome lower end part become large as shown in form V2 at the time of when damping does not occur, in comparison with the undeformed form V1. In the present embodiment, by providing the dome rib part 127 in a concentric form for damping in the parts of which the amplitudes are great, the damping effect due to mass can be gained and, thereby, the resonance of the diaphragm can be restrained. Since the distribution forms of the dome rib parts 127 are of arc forms, the resonances of the dome rib parts that would occur in the case that the distribution forms thereof are of circular forms can be reduced.

Figure 24:
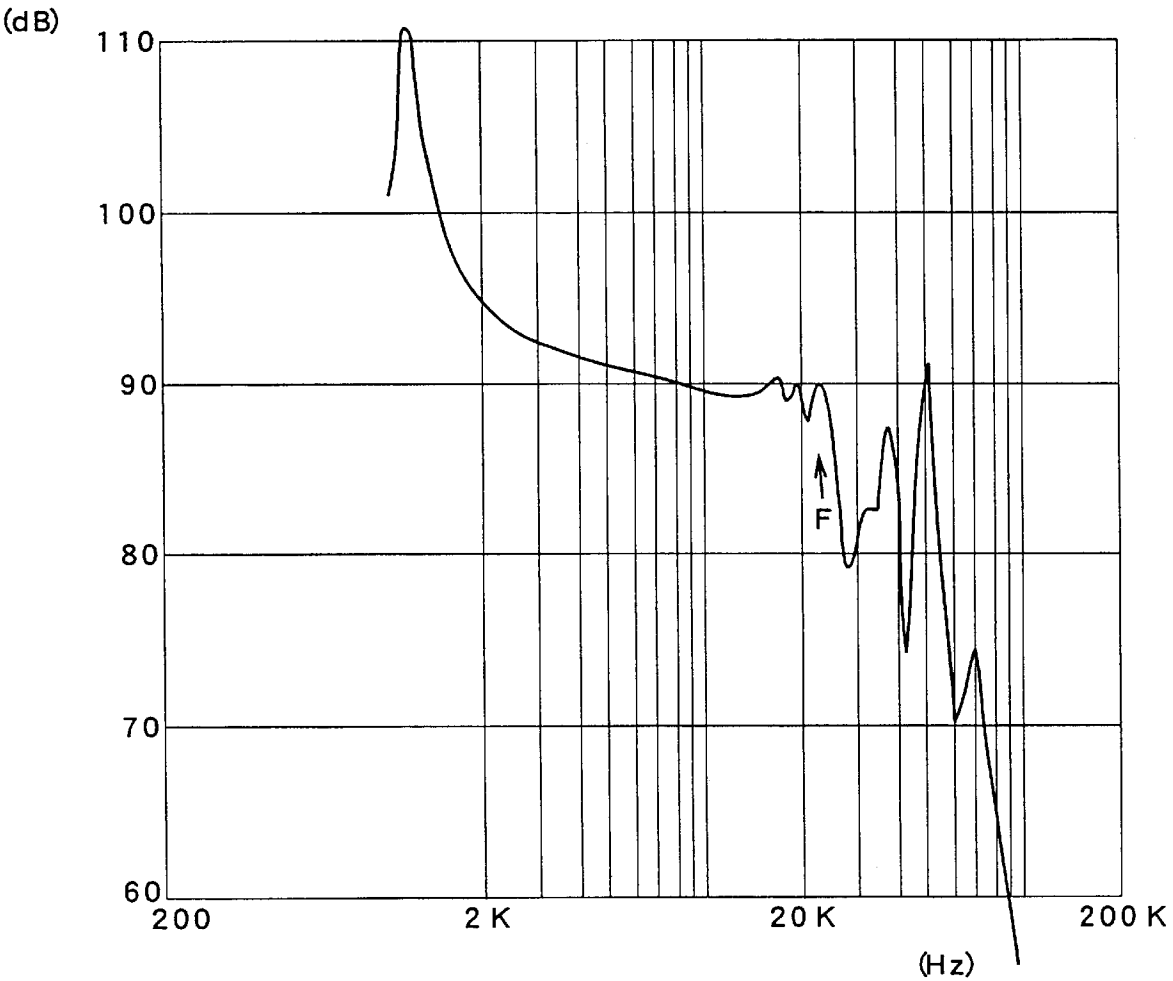
FIG. 24 is a characteristics graph showing the analysis result of the sound pressure level vs. frequency characteristic of the loud speaker according to Embodiment 10.

FIG. 24 shows the sound pressure level vs. frequency characteristics of the loud speaker according to the present embodiment. It is understood that the dip, which has occurred at the frequency F in the figure, is eliminated. In the present embodiment, the dome rib parts 127*a* in a concentric form are described. However, in the case that the dome rib parts 127*b* in an elliptical form are provided, the long diameter part and the short diameter part are arranged so as to cross both the dome central part 126 and the lower end part of the concentric circles and, thereby, the same effects as the mass damping effects of the dome rib parts 127*a* in concentric circles can be gained.

Figure 25:
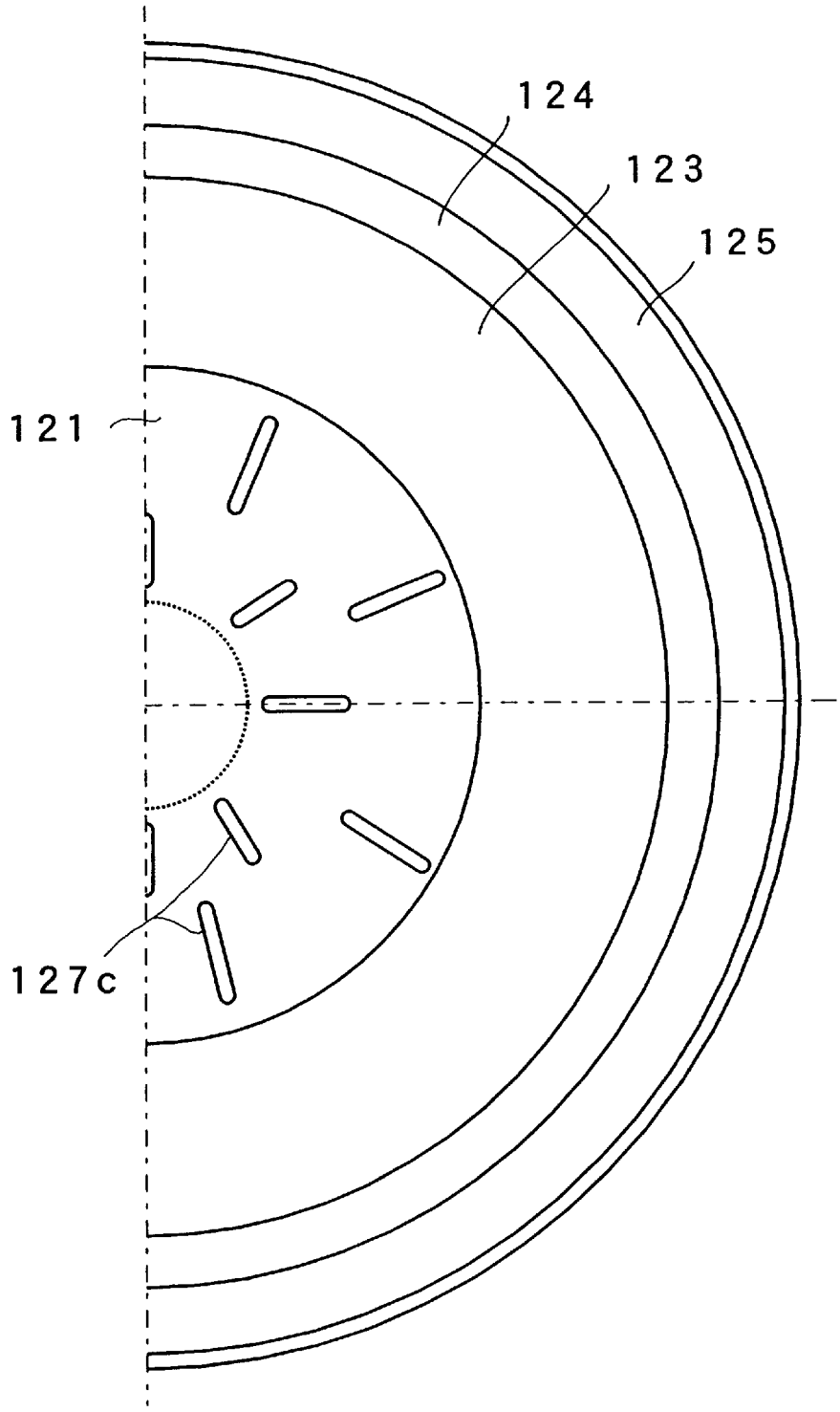
FIG. 25 is a plan view showing the structure of a diaphragm (part 3) of the loud speaker according to Embodiment 10.

FIG. 25 is a plan view showing a structural example (part 3) of the diaphragm 120 according to the present embodiment and shows the right half of the diaphragm. Here, the dome rib parts 127*c* in a radiating form are provided, respectively, in the dome central part 126 and in the vicinity of the lower end part.

Embodiment 11

Next, the structure of the diaphragm of a loud speaker according to Embodiment 11 of the present invention is primarily described in reference to the drawings. Here, the present embodiment is described wherein the same symbols are attached to same parts as in Embodiment 1 in the drawings.

Figure 26:
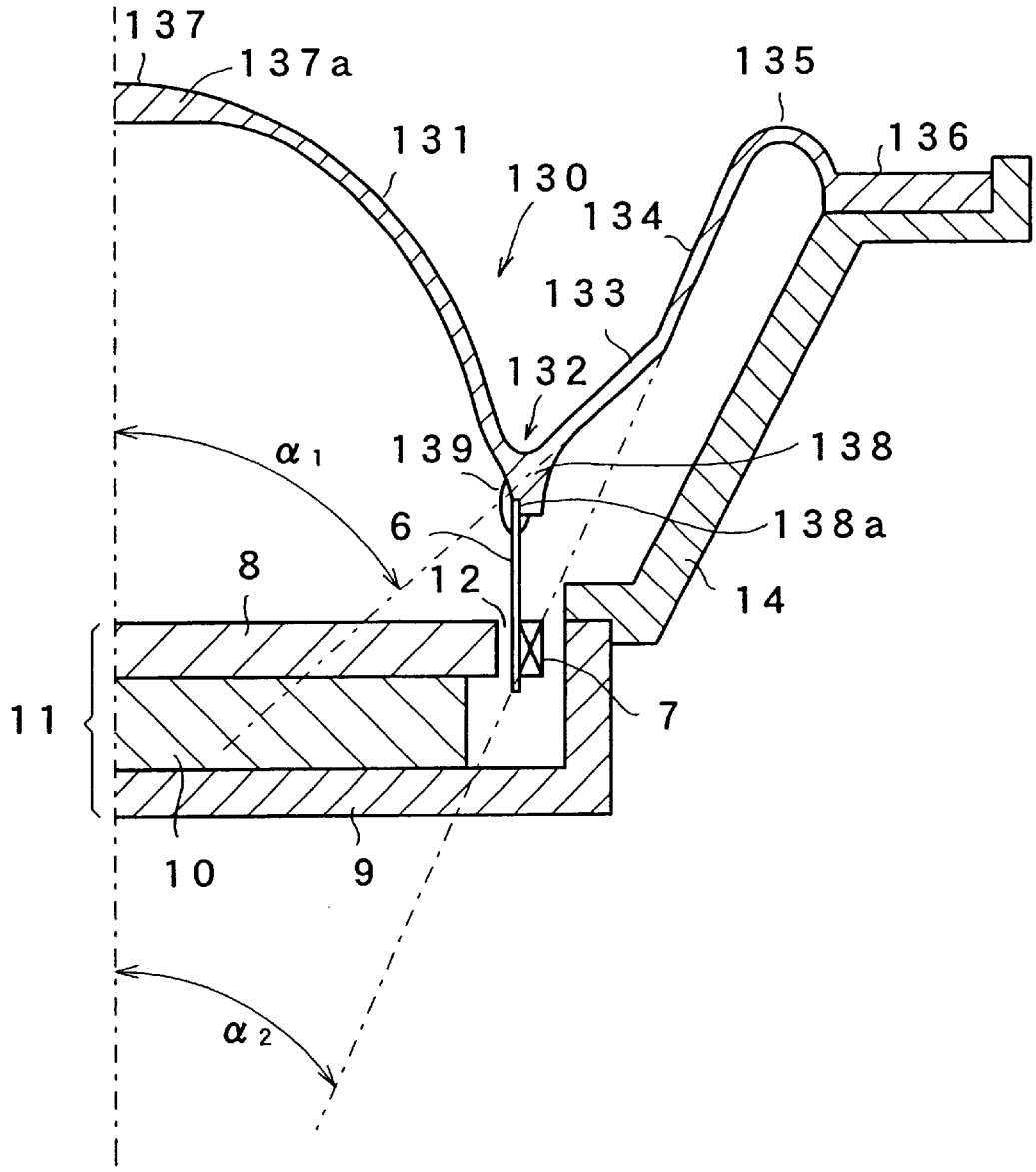
FIG. 26 is a cross section view showing half of the structure of a loud speaker according to Embodiment 11 of the present invention.

FIG. 26 is a cross section view showing half of the structure of the loud speaker of the present embodiment. As shown in this figure, this loud speaker is formed to include a voice coil bobbin 6, a voice coil 7, a plate 8, a yoke 9, a magnetic 10, a frame 14 and a diaphragm 130, which has a new cross sectional form.

The diaphragm 130 of the present embodiment is gained by uniting a dome shaped diaphragm, of which the cross section is of an arc form, with first and second cone diaphragms, of which the cone angles differ. This diaphragm 130 is integrally formed of a dome part 131, a voice coil junction part 132, a first cone part 133, a second cone part 134, roll-surrounds 135 and a frame pasting part 136.

The central part of the dome part 131 is referred to as a dome central part 137. The dome central part 137 has a lump 137*a*, of which the thickness is greater than the average thickness of the dome part 131. An annular rib 138 protrudes from the voice coil junction part 132 toward the voice coil and has a level difference 138*a*. The level difference 138*a* is engaged with the outer diameter part or the inner diameter part of the voice coil bobbin 6. The level difference 138*a* part enhances the adhesion of the voice coil bobbin 6 to the diaphragm 130 and increases the positioning accuracy of the voice coil bobbin 6 relative to the diaphragm 130.

The voice coil bobbin 6 is attached to the level difference 138*a* of the annular rib 138 by using adhesive 139. The first cone part 133 and the second cone part 134 are formed in the area from the voice coil junction part 132 to the peripheral part of the diaphragm 130. The first cone part 133 has a cone angle $\alpha 1$ vis-à-vis central axis of the diaphragm 130 while the second cone part 134 has a cone angle $\alpha 2$ vis-à-vis the central axis of the diaphragm 130. As for the cone angles, the effects thereof are reported in detail by using a general loud speaker that has only a cone diaphragm. The first cone part 133 is arranged inside with a large cone angle. The second cone part 134, having a small cone angle, is arranged outside of the first cone part 133. In such a manner, the cone parts of the diaphragm of the present embodiment are characterized by being formed of a plurality of cone angles. Though in FIG. 26, $\alpha 2$ is smaller than $\alpha 1$, $\alpha 2$ may be greater than $\alpha 1$ and, in general, $\alpha 1$ and $\alpha 2$ are different angles. These cone parts are diaphragms that produce an air vibration as does the dome part 131.

The roll-surrounds 135 are formed around the external periphery of the second cone part 134. The roll-surrounds 135 provide elasticity so that the dome part 131 and the cone parts 133, 134, which are the main elements of the diaphragm 130, cause vibration.

The frame pasting part 136 is formed in the peripheral part of the roll-surrounds 135. The frame pasting part 136 is formed so that the thickness thereof is, sufficiently, greater than the average thickness of the diaphragm 130. The frame 14 via the frame pasting part 136 supports the diaphragm 130.

The junction part of the level difference 138*a* is slightly larger than the external form of the voice coil bobbin 6 so that the voice coil bobbin 6 can be firmly attached by using adhesive 139. In addition, by making the thickness of the frame pasting part 136 two times, or more, greater than the average thickness of the diaphragm, curvature or twist caused at the time of the formation of the diaphragm can be prevented so that the dimensional accuracy of the finish of the diaphragm can be enhanced. Accordingly, a gap defect wherein the voice coil 6 contacts the plate within the magnetic gap 12 or the form distortion of the voice coil bobbin 6 is reduced so that the production efficiency of the diaphragm can be increased.

Figure 27:
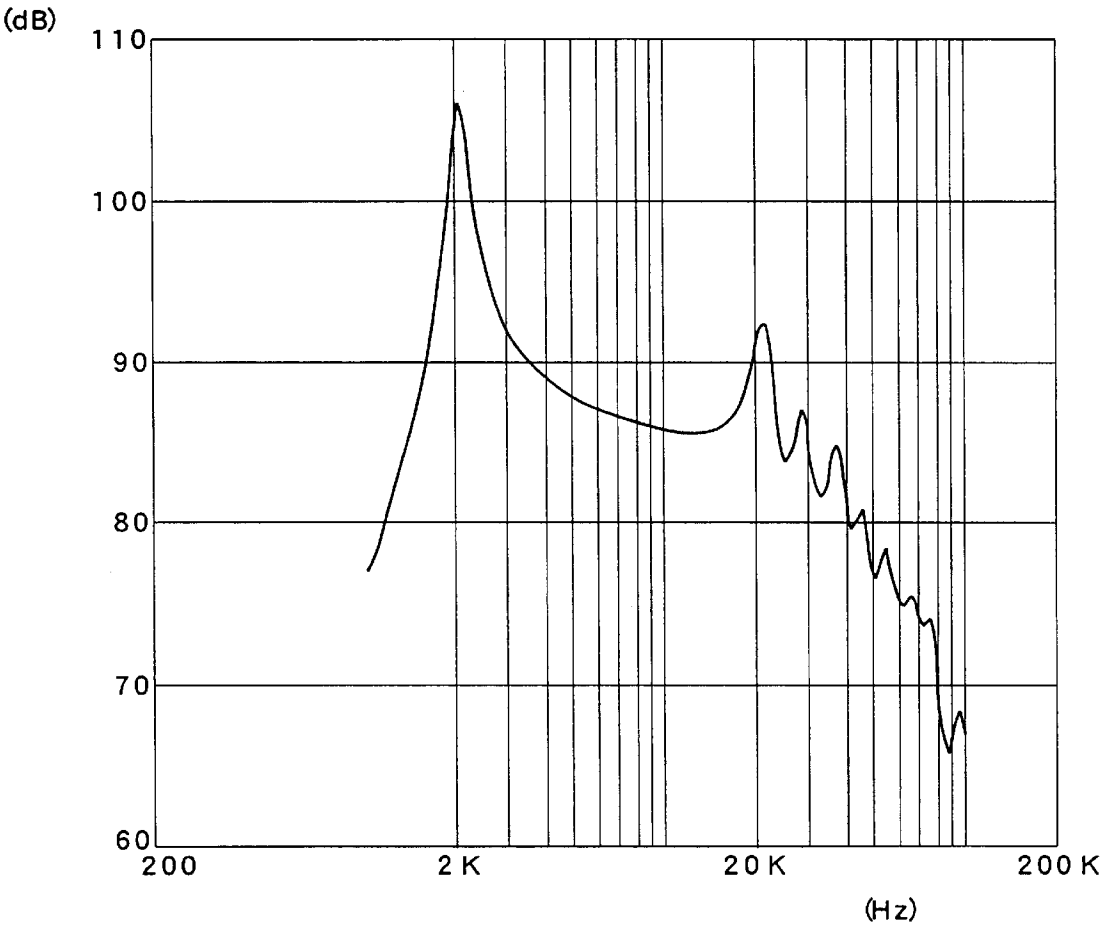
FIG. 27 is a characteristics graph (part 1) showing the analysis result of the sound pressure level vs. frequency characteristic of the loud speaker according to Embodiment 11.
Figure 28:
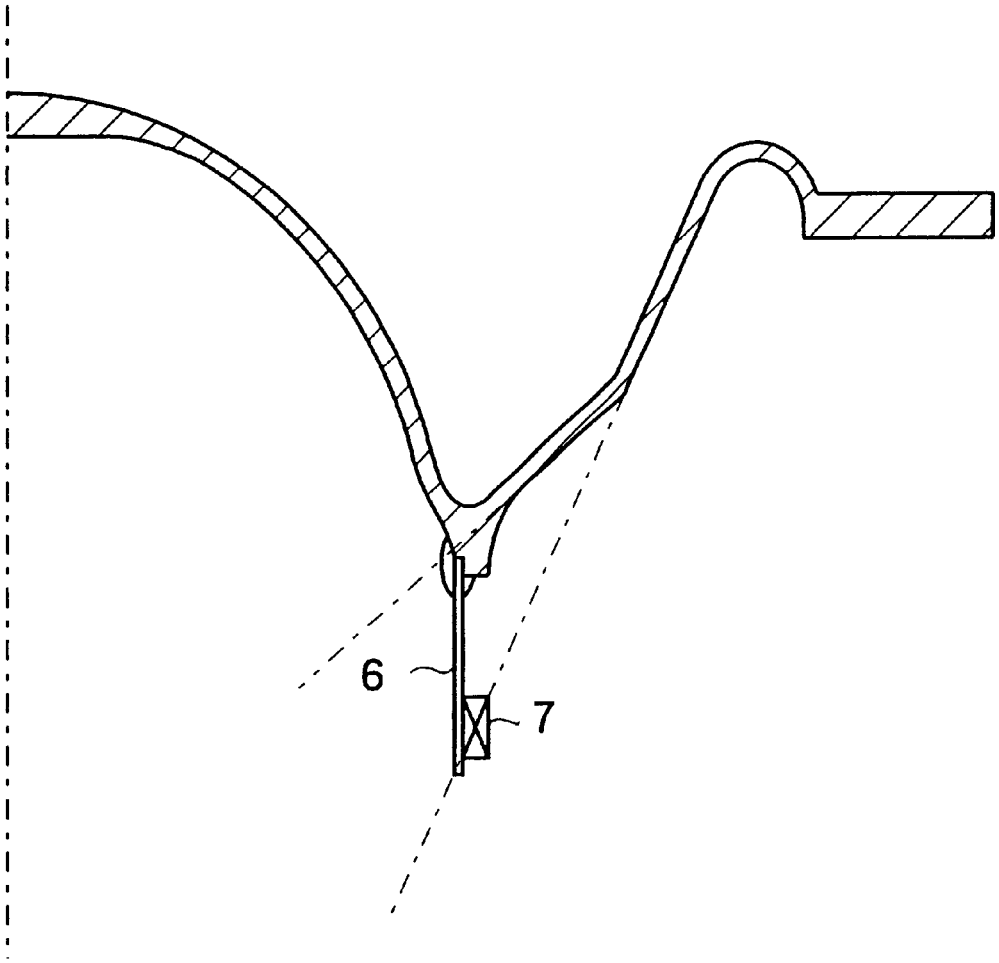
FIG. 28 is a cross section view showing half of the structure of a diaphragm of the loud speaker according to Embodiment 11.

FIG. 27 shows the sound pressure level vs. frequency characteristics of the case where the cone parts according to the present embodiment calculated by means of a finite element method are used as a diaphragm. A model in a form as shown in FIG. 28 is used as the object of the calculation model.

Figure 29:
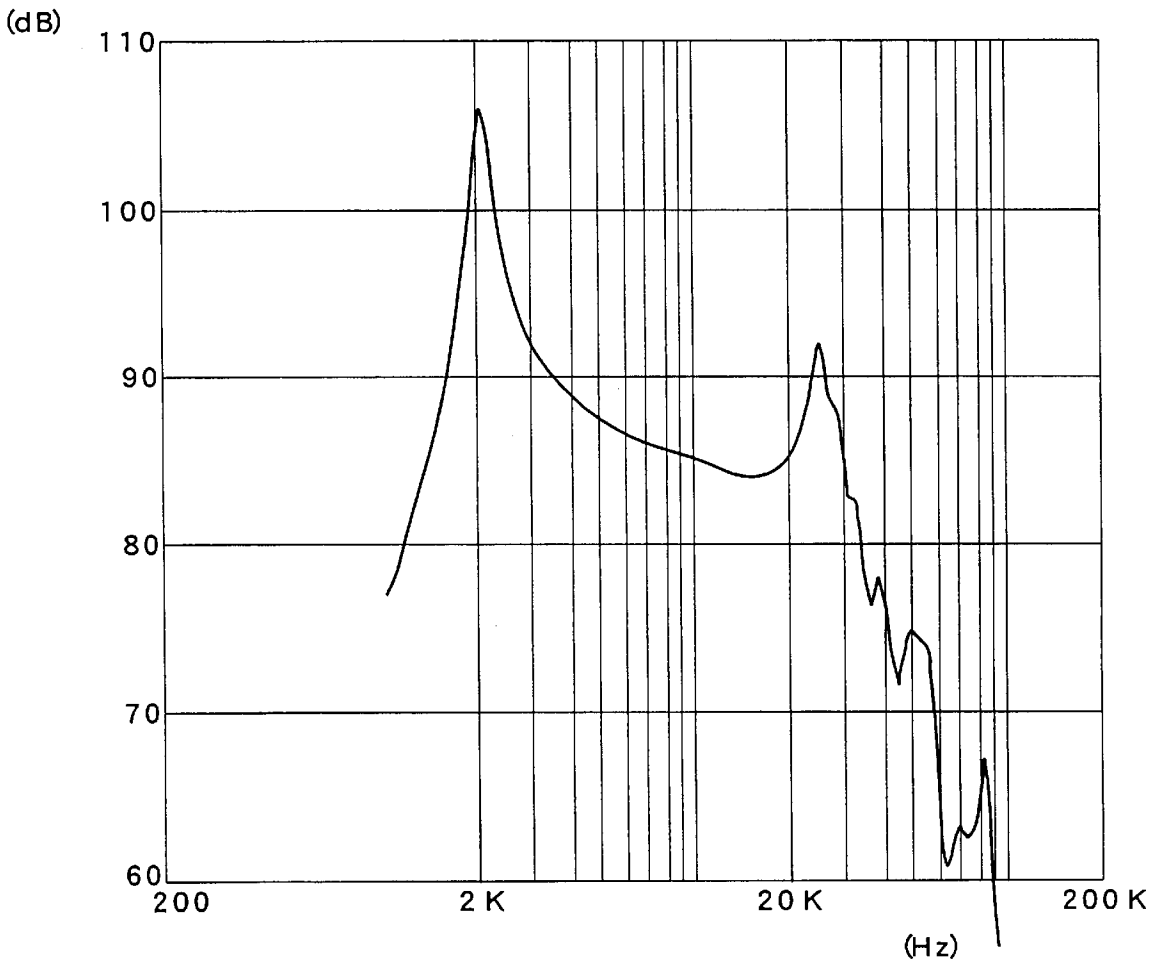
FIG. 29 is a characteristics graph (part 2) showing the analysis result of the sound pressure level vs. frequency characteristic of the loud speaker according to Embodiment 11.
Figure 30:
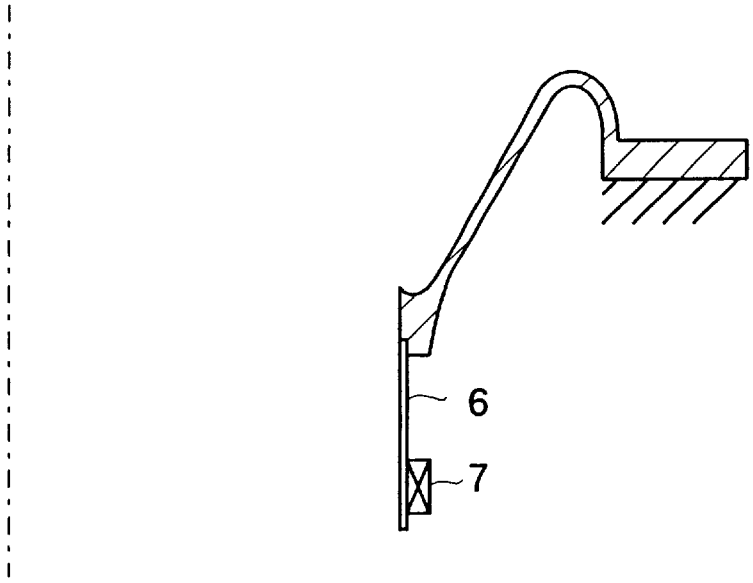
FIG. 30 is a cross section view showing half of the structure of a diaphragm, for the purpose of comparison, in the loud speaker according to Embodiment 11.

FIG. 29 shows the frequency characteristics of the case where a cone part having a single cone angle is used as the object of the model. Here, the height and the external diameter of the cone part are the same as shown in FIG. 28. Since the resonant frequency is uniquely determined in the case of a single cone angle as shown in FIG. 30, a large dip is generated after the primary resonance in the frequency characteristics. However, since a plurality of cone angles exist in the cone parts of the diaphragm 130 of the loud speaker according to the present embodiment, resonance due to mutual relationships of the cone angles is generated as shown in FIG. 27 in addition to the resonance frequencies determined by respective cone angles and the response becomes attenuated while repeating small peaks and dips.

Since the external diameter of the dome part is small in this embodiment, there is an effect such that the resonance frequency due to the enlargement of the cone angle can be prevented from lowering. Accordingly, the diaphragm of the present embodiment makes the reproduction up to high frequency possible.

Embodiment 12

Next, making processes for the diaphragms used for the loud speakers of the above embodiments are described. Here, first, a metallic mold for manufacturing the diaphragm 110 according to Embodiment 9 is described. Here, as for the diaphragms having other forms, only the detailed forms of the metallic mold are different while injection molding to form a diaphragm by injecting molding material that is heated and melted using an injection machine is the same for the above diaphragms having other forms.

Figure 31:
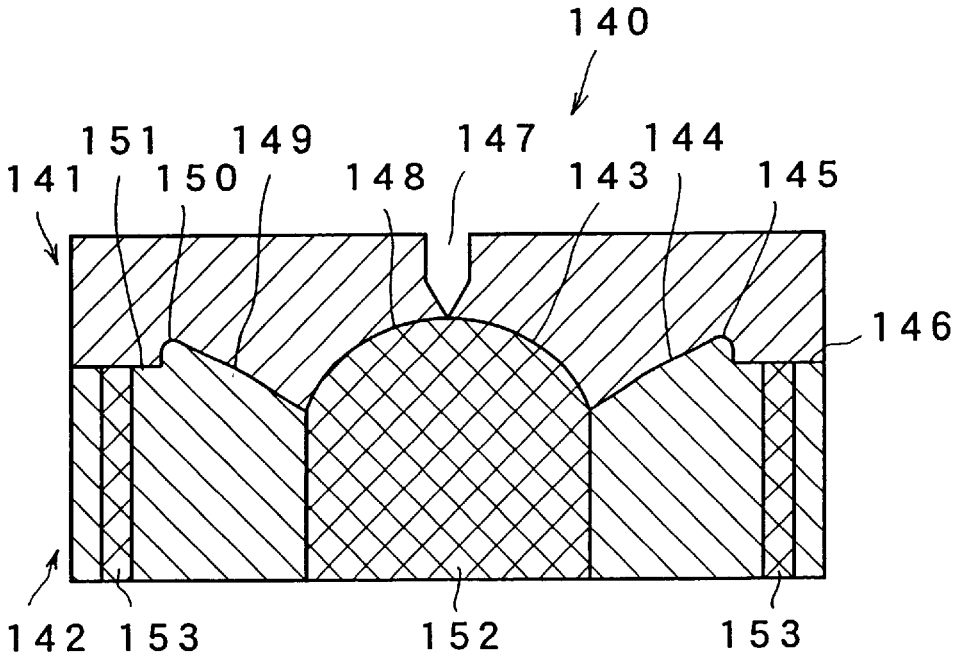
FIG. 31 is schematic cross section view of a metallic mold used for injection mold of a diaphragm of the loud speaker according to the present invention.

FIG. 31 is a cross section view showing a schematic structure of a metallic mold 140 for injecting and forming thermoplastic resin into a diaphragm according to the present invention. This metallic mold 140 is formed of a first heating mold assembly 141, which is a male mold, and a second heating mold assembly 142, which is a female mold. Though the formation surfaces of the heating mold assembly 141 and the heating mold assembly 142 are of approximately the same form, they are different by the amount corresponding to the differences in the thicknesses of respective portions of the diaphragm 110.

A dome part formation surface 143 in a recess form, a cone part formation surface 144 in a cone form, a surrounds formation surface 145 in a step form and a frame pasting part formation surface 146 in a plane form are formed in the heating mold assembly 141. All of the formation surfaces are coaxial and formed to have a mirror finish. As shown in FIG. 31, a gate 147 is provided in order to inject thermoplastic resin into the central axis of the dome part formation surface 143. The injection hole of the gate 147 is reduced to a small size. In addition, the heating mold assembly 141 has a heater for heating built into the inside or it can be heated by other members. Then, the heating mold assembly 141 is supported by a shank, which is not shown, so as to be movable in the direction of the central axis.

The heating mold assembly 142 has a dome part formation surface 148 in a recess form, a cone part formation surface 149 in a mortar form, a surrounds formation surface 150 in a step form and a frame pasting part formation surface 151 in a plane form. All of the formation surfaces are coaxial and are formed to have a mirror finish. Here, as shown in FIG. 31, the dome part formation surface 148 is formed of the head part of a central projection pin 152 so as to work as a mold surface when the central projection pin 152 is at a set position.

In addition, a plurality of peripheral projection pins 153, in an annular form, is buried in the peripheral part of the heating mold assembly 142 so as to be able to slide freely. The head parts of these peripheral projection pins 153 are flat and form parts of the frame pasting part formation surface 151. In addition, the heating mold assembly 142 has a heater for heating built into the inside thereof.

When these heating mold assemblies 141 and 142 are at the injection molding position, the gaps for respective formation surfaces differ according to the finished dimensions, that is to say, according to the thicknesses of the respective portions of the diaphragm. Here, the gate for injecting thermoplastic resin is not limited to the position shown in FIG. 31 but, rather, may be provided in a portion where the thickness of the molded part is the greatest. In the example shown in FIG. 18, in order to provide a lump 116*a* in the dome central part 116, one gate 147 is provided in the central axis of the heating mold assembly 141, as shown in FIG. 31. In the case that, for example, the thickness of the frame pasting part 115 is made to be great, a plurality of gates in an annular form are provided in portions of the frame pasting part formation surface 146. In addition, in the case that the thickness of the voice coil junction part 112 is made to be great, a plurality of gates in an annular form may be arranged along the border part between the dome part formation surface 143 and the cone part formation surface 144.

In the positions shown in FIG. 31, the flow of melted material in a radiating form is taken into consideration so that weld lines do not easily occur and the distances of flow to respective portions of the diaphragm 110 can be made equal. When such a center gate is adopted, the form of the diaphragm is, advantageously, made uniform. In addition, as for the positions of the peripheral projection pins 153, providing them in the thick portion, as shown in the figure, is advantageous in order to prevent the deformation of the molded product when they are made to protrude.

Figure 32:
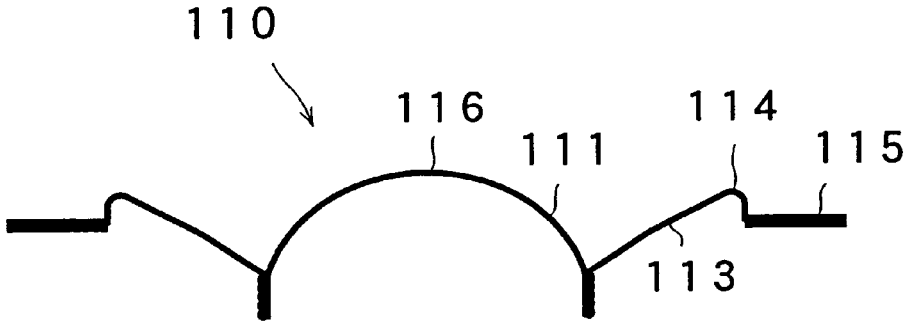
FIG. 32 is a cross section view showing the structure of a diaphragm gained according to Embodiment 12 of the present invention.

FIG. 32 is a cross section view showing the entire form of the diaphragm 110 that is gained by injecting and molding thermoplastic resin, such as polypropylene, polyethylene, polystyrene, ABS, or the like, using the above metallic mold 140. Here, the same symbols are attached to same parts as in FIG. 18. The thickness of the dome central part 116, to which the gate 147 of FIG. 31 is provided, becomes 200 $\mu$m while the thickness of the peripheral portion of the dome central part 116 becomes 50 $\mu$m. In addition, the thickness of the cone part 113 is 50 $\mu$m while the frame pasting part 115, of which the thickness is 400 $\mu$m, is the thickest portion. In addition, the roll-surrounds 114 for securing the amplitude of the cone part 113, of which the thickness is 30 $\mu$m, is the thinnest portion. When a material such as a polypropylene resin which contains, for example, mica is used, it is advantageous to lower the distortion so as to have a high internal loss and so as to gain excellent properties of chemical resistance, heat resistance, and the like. In addition, costs are low and the effect of compensating for the rigidity can be gained.

By fabricating a diaphragm in such a manner by means of a junction formation method of thermoplastic resin, the thickness or the form of the diaphragm can be freely selected so that the dispersion of the dimensions of the molded products is reduced. In addition, by making the thickness of the peripheral flat portion of the diaphragm great, curvature or deformation can be prevented.

As for the material of the diaphragm of the present invention, almost all of the resins can be utilized as long as they are thermoplastic resins and, for example, in the case that the raising of the rigidity is desired, that can be achieved by mixing fillers, such as mica or glass fiber, with the thermoplastic resin as described above. In addition, in the case that it coloring is desired, that can be implemented by mixing color pigment powder with the thermoplastic resin. Elastomer can also be used. Furthermore, metallic material that can be melted may also be used.

Figure 33:
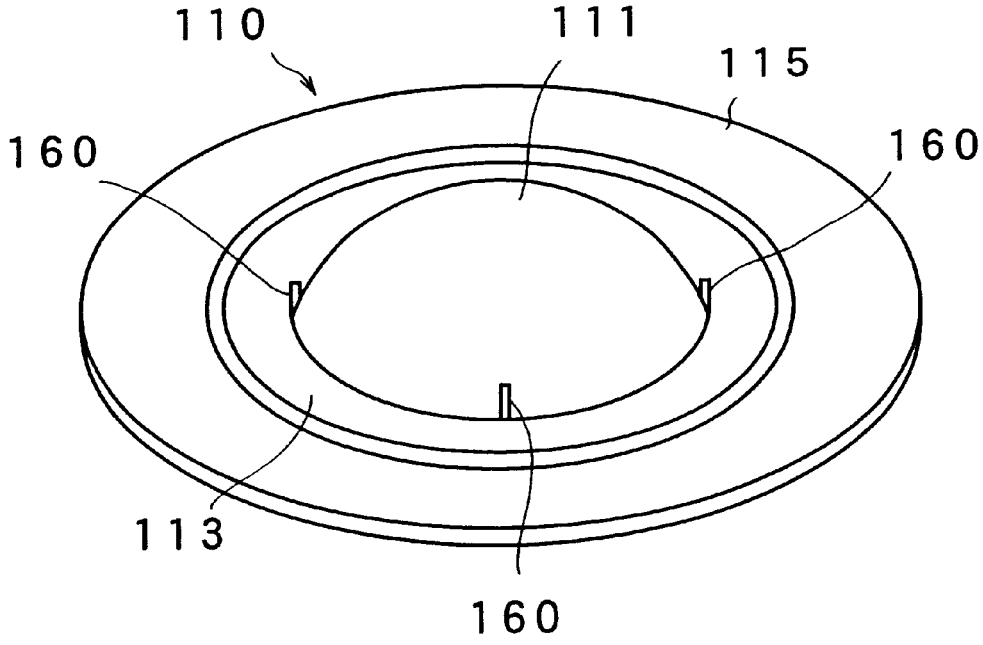
FIG. 33 is a view showing the appearance of the structure of a diaphragm (part 1) gained according to Embodiment 12.

FIG. 33 is a perspective view of the appearance of the diaphragm in the case that a plurality of gates 160 is provided, in a dispersed manner, along the junction part between the dome part 111 and the cone part 113. In this case, gate portions (burrs) that are residue portions of the resin are generated in the axis direction on the formed diaphragm.

Figure 34:
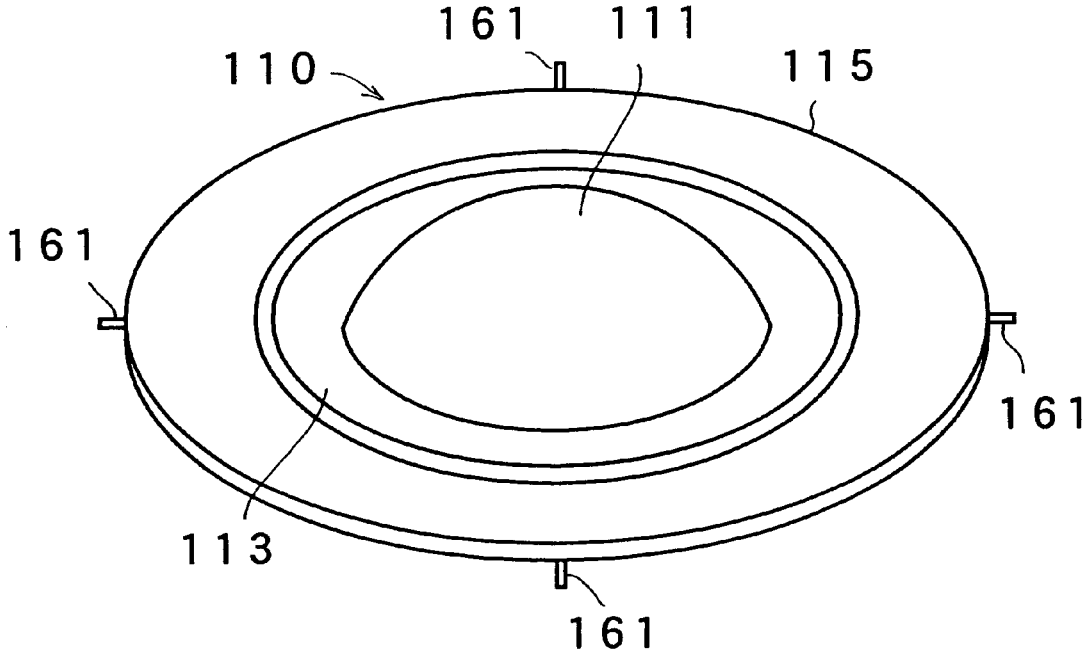
FIG. 34 is a view showing the appearance of the structure of a diaphragm (part 2) gained according to Embodiment 12.

In addition, FIG. 34 is a perspective view of the appearance of a diaphragm in the case that a plurality of gates 161 is provided, in a dispersed manner, along the frame pasting part 115. In this case, gate portions, which are residue portions of the resin, occur in a plane perpendicular to the central axis on the formed diaphragm.

In any case, when the gate from which melted resin is injected is provided at the central axis of the metallic mold, a dome central part, of which the thickness is great due to a lump of resin, is formed and the melted resin can be easily made to flow in a radiating form to all corners across the respective formation surfaces of the heating mold assemblies 141 and 142. When the distance of flow of the melted resin is short, the conveyance of heat to the central part and to the peripheral part becomes uniform while the injection pressure is strong and, therefore, the properties of the respective portions of the diaphragm become constant. This also means that the quality of the entirety of the diaphragm is stabilized. In addition, the melted resin easily fills in the voice coil junction part that is located at a distance away from the gate so that the volume of this part can be made large.

In addition, according to the process of the present embodiment, the roll-surrounds 114 can be formed to have the thickness of 30 $\mu$m, which is much thinner than the conventional thickness, being 40 $\mu$m to 50 $\mu$m, of the roll-surrounds of the diaphragm. Accordingly, the basic resonance frequency F0 of the diaphragm can be set lower than in the case of a sheet formation method. Therefore, the effect can be gained wherein the reproduction frequency range can be expanded toward lower frequencies even in the case that the diaphragm is for a tweeter. In addition, it is found that the reproduction sound frequency range is expanded up to a value of from 70 kHz to 80 kHz for the diaphragm manufactured by means of injection mold according to the present invention in comparison with the diaphragm gained by means of a conventional sheet formation method, of which the limit of the reproduction high frequency sound range is a value of from 30 kHz to 40 kHz.

According to a conventional process for a diaphragm, a diaphragm is pressed and cut so as to adjust the external form into a predetermined form after the formation of the diaphragm and, therefore, after the external form is punched out an excess portion, which is 30% to 50% of the utilized materials, is generated. According to the process of injection mold of the present invention, however, the excess portion after external form molding can be utilized by being melted again so that a high material yield, up to 80%, can be gained.

In addition, though the above described process for a diaphragm is based on injection mold by means of heating and melting the original material, a diaphragm can be manufactured through a cutting operation of a block of metal-based material. In particular, an injection mold method or a general molding method that uses a metallic mold cannot be adopted for a metal of poor malleability or a metal with a high melting point. In addition, most of such metallic materials have a large $E/\rho$ (E is a Young's modulus, $\rho$ is a density).

Such a metal-based diaphragm can be used for the part where the environmental temperature greatly varies because heat resistance is high in comparison with resins. In addition, since the value of $E/\rho$ is great, a loud speaker of low distortion over a broad frequency range can be implemented.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The text of Japanese priority application no. 2000-352597 filed Nov. 20, 2000 is hereby incorporated by reference.

What is claimed is:

1. A loudspeaker comprising:

a diaphragm formed in one piece having a first portion having a first thickness and a second portion having a second thickness, said second portion extending outwardly from and around said first portion, said first portion including at least a central dome part, the first thickness being greater than the second thickness for distortion reduction, a voice coil junction part formed around a periphery of said second portion and a peripheral part extending outwardly from said voice coil junction part;

a voice coil bobbin having a cylindrical shape connected at one end portion to said voice coil junction part, a voice coil disposed around a peripheral part of said voice coil bobbin; and a magnetic circuit for providing an electromagnetic driving force to said voice coil.

2. A loudspeaker according to claim 1, wherein said peripheral part includes a surrounding portion and a frame pasting part; and wherein a thickness of said voice coil junction part is greater than the second thickness of said second portion.

3. A loudspeaker according to claim 1, wherein said peripheral part includes a frusto-conical portion, a surrounding portion and a frame pasting part.

4. A loudspeaker according to claim 1, wherein said peripheral part includes a frusto-conical portion, a surrounding portion and a frame pasting part; and wherein a thickness of the voice coil junction part is greater than the second thickness of said second portion.

5. A loudspeaker according to claim 1, wherein said peripheral part includes a frusto-conical portion, a surrounding portion and a frame pasting part; and wherein said voice coil junction part includes an annular rib for making a junction with said voice coil bobbin.

6. A loudspeaker according to claim 1, wherein said peripheral part includes a frusto-conical portion, a rolled surrounding portion and a frame pasting part.

7. A loudspeaker according to claim 1, wherein said peripheral part includes a frusto-conical portion, a rolled surrounding portion and a frame pasting part; and wherein said voice coil junction part includes an annular rib for making a junction with said voice coil bobbin.

8. A loudspeaker according to claim 7, wherein a thickness of said rolled surrounding portion is less than the first thickness of said first portion.

9. A loudspeaker according to claim 1, wherein the effective radiation areas of said dome part and said cone part are approximately equal.

10. A loudspeaker according to claim 1, wherein said peripheral part includes a frusto-conical portion, a rolled surrounding portion and a frame pasting part; and wherein said voice coil junction part includes an annular rib for making a junction with said voice coil bobbin; and wherein a thickness of said frame pasting part is greater than the first thickness of said first portion.

11. A loudspeaker according to claim 1, wherein said peripheral part includes a frusto-conical portion, a rolled surrounding portion and a frame pasting part; and wherein a thickness of said frame pasting part and the first thickness of said first portion are greater than the second thickness of said second portion; and wherein said diaphragm includes a plurality of dome rib parts each having a thickness greater than the second thickness of the second portion.

12. A loudspeaker according to claim 11, wherein each of said dome rib parts has an arc form arranged around said central dome part.

13. A loudspeaker according to claim 11, wherein said dome rib parts extend radially outwardly around said central dome part.

14. A loudspeaker according to claim 1, wherein said peripheral part includes a frusto-conical portion, a rolled surrounding portion and a frame pasting part; and wherein said frusto-conical portion is formed of a first frusto-conical portion having a cone angle $\alpha 1$ and a second frusto-conical portion having a cone angle $\alpha 2$ which is different than the angle $\alpha 1$.

15. A loudspeaker comprising:

a diaphragm formed in one piece having a first portion having a first thickness and a second portion having a second thickness, said second portion extending outwardly from and around said first portion, said first portion including at least a central dome part, the first thickness being greater than the second thickness for distortion reduction, said diaphragm having a third portion having a third thickness including a voice coil junction part formed adjacent to said second portion, the third thickness being greater than the second thickness for increasing rigidity of said diaphragm, and a peripheral part extending outwardly from said voice coil junction part;

a voice coil bobbin having a cylindrical shape connected at one end portion to said voice coil junction part, a voice coil disposed around a peripheral part of said voice coil bobbin; and a magnetic circuit for providing an electromagnetic driving force to said voice coil.

16. A loudspeaker comprising:

a diaphragm formed in one piece having a first portion having a first thickness and a second portion having a second thickness, said second portion extending outwardly from and around said first portion, said first portion including at least a central dome part, the first thickness being greater than the second thickness for distortion reduction, said diaphragm having a third portion having a third thickness including a voice coil junction part formed adjacent to said second portion, the third thickness being greater than the second thickness for increasing rigidity of said diaphragm, and said diaphragm having a fourth portion having a fourth thickness including a peripheral part extending outwardly from said voice coil junction part, the third thickness being greater than the fourth thickness;

a voice coil bobbin having a cylindrical shape connected at one end portion to said voice coil junction part, a voice coil disposed around a peripheral part of said voice coil bobbin; and a magnetic circuit for providing an electromagnetic driving force to said voice coil.

17. A loudspeaker comprising:

a diaphragm formed in one piece having a first portion having a first thickness and a second portion having a second thickness, said second portion extending outwardly from and around said first portion, said first portion including at least a central dome part, said diaphragm having a third portion having a third thickness including a voice coil junction part formed adjacent to said second portion, the third thickness being greater than the second thickness for increasing rigidity of said diaphragm, and said diaphragm having a fourth portion having a fourth thickness including a peripheral part extending outwardly from said voice coil junction part;

a voice coil bobbin having a cylindrical shape connected at one end portion to said voice coil junction part, a voice coil disposed around a peripheral part of said voice coil bobbin; and a magnetic circuit for providing an electromagnetic driving force to said voice coil.

18. A loudspeaker as defined in claim 17, wherein the third thickness is greater than the fourth thickness.

* * * * *